US007247846B2

(12) United States Patent
Buttrill, Jr.

(10) Patent No.: US 7,247,846 B2
(45) Date of Patent: Jul. 24, 2007

(54) ELECTRIC SECTOR TIME-OF-FLIGHT MASS SPECTROMETER WITH ADJUSTABLE ION OPTICAL ELEMENTS

(75) Inventor: Sidney E Buttrill, Jr., Palo Alto, CA (US)

(73) Assignee: Ciphergen Biosystems, Inc., Fremont, CA (US)

( * ) Notice: Subject to any disclaimer, the term of this patent is extended or adjusted under 35 U.S.C. 154(b) by 0 days.

(21) Appl. No.: 11/148,865

(22) Filed: Jun. 8, 2005

(65) Prior Publication Data

US 2005/0224708 A1 Oct. 13, 2005

Related U.S. Application Data

(63) Continuation of application No. 10/758,326, filed on Jan. 14, 2004, now Pat. No. 6,998,606, which is a continuation of application No. 10/424,351, filed on Apr. 24, 2003, now Pat. No. 6,867,414.

(60) Provisional application No. 60/413,406, filed on Sep. 24, 2002.

(51) Int. Cl.
*H01J 49/40* (2006.01)

(52) U.S. Cl. ..... 250/287; 250/281; 250/282; 250/283; 250/396 R; 250/398

(58) Field of Classification Search ..... None
See application file for complete search history.

(56) References Cited

U.S. PATENT DOCUMENTS

| | | | |
|---|---|---|---|
| 3,576,992 | A | 5/1971 | Moorman et al. |
| 3,745,343 | A | 7/1973 | Halliday et al. |
| 3,863,068 | A | 1/1975 | Poschenrieder |
| 3,986,025 | A | 10/1976 | Fujiwara et al. |
| 4,234,791 | A | 11/1980 | Enke et al. |
| 4,472,631 | A | 9/1984 | Enke et al. |
| 4,754,135 | A | 6/1988 | Jackson |
| 4,774,408 | A | 9/1988 | Gohlke |
| 4,800,273 | A | 1/1989 | Phillips |
| 4,855,596 | A | 8/1989 | Gruen et al. |
| 4,864,130 | A | 9/1989 | Gruen et al. |
| 4,889,987 | A | 12/1989 | Gruen et al. |
| 4,945,236 | A | 7/1990 | Mogami et al. |

(Continued)

FOREIGN PATENT DOCUMENTS

| | | |
|---|---|---|
| JP | 63-266751 | 11/1988 |
| JP | 08-007831 | 1/1996 |
| JP | 11-135061 | 5/1999 |
| JP | 11-195398 | 7/1999 |
| JP | 11-297267 | 10/1999 |
| JP | 2000-243345 | 9/2000 |
| JP | 2000-243346 | 9/2000 |
| JP | 2003-086129 | 3/2003 |

OTHER PUBLICATIONS

Matsuda, H., "High-resolution mass spectrometer," Shitsuryo Bunseki vol. 33, No. 4, pp. 227-234 (1985).

(Continued)

*Primary Examiner*—Nikita Wells
(74) *Attorney, Agent, or Firm*—Fish & Neave IP Group Ropes & Gray LLP; James F. Haley, Jr.; Tae Bum Shin

(57) ABSTRACT

The invention provides apparatus and methods for performing time-of-flight (TOF) mass spectrometry. A TOF mass spectrometer of the present invention comprises one or more ion focusing electric sectors. At least one of the electric sectors is associated with an ion optical element. The ion optical elements comprise at least one adjustable electrode, such that the adjustable electrode is able to modify the potential experienced by an ion entering or exiting the electric sector with which it is associated.

26 Claims, 11 Drawing Sheets

U.S. PATENT DOCUMENTS

| | | | | |
|---|---|---|---|---|
| 4,959,544 | A | 9/1990 | Sukenobu | |
| 4,973,842 | A | 11/1990 | Gruen et al. | |
| 5,032,723 | A | 7/1991 | Kono | |
| 5,097,125 | A | 3/1992 | Gruen et al. | |
| 5,128,543 | A | 7/1992 | Reed et al. | |
| 5,194,732 | A | 3/1993 | Bateman | |
| 5,198,666 | A | 3/1993 | Bateman | |
| 5,357,107 | A | 10/1994 | Ibach et al. | |
| 5,365,064 | A | 11/1994 | Rettinghaus | |
| 5,665,967 | A | 9/1997 | Coxon et al. | |
| 5,696,375 | A | 12/1997 | Park et al. | |
| 6,300,625 | B1 | 10/2001 | Ishihara | |
| 6,600,155 | B1 | 7/2003 | Andrien et al. | |
| 6,674,069 | B1 * | 1/2004 | Martin et al. | 250/287 |
| 6,867,414 | B2 * | 3/2005 | Buttrill, Jr. | 250/287 |
| 6,998,606 | B2 * | 2/2006 | Buttrill, Jr. | 250/287 |
| 2004/0149901 | A1 | 8/2004 | Buttrill, Jr. | |

OTHER PUBLICATIONS

Matsuo, T., et al., "Ion optics of new TOF mass spectrometer in the order approximation," Nucl. Instrum. Methods Phys, Res. Sect. A, vol. A256, No. 3, pp. 327-330 (1987).

Nose, N., "High-resolution time-of-flight analyzer for charge exchange process," Shitsuryo Bunseki vol. 31, No. 3, pp. 165-172 (1983).

Sakurai et al., "Ion Optics for Time-of-Flight Mass Spectrometers with Multiple Symmetry," Int. J. Mass. Spectrom. Ion Proc. 63: pp. 273-287 (1985).

Sakurai et al., "A New Time-of-Flight Mass Spectrometer," Int. J. Mass. Spectrom. Ion Proc. 66: pp. 283-290 (1985).

Wollnik, Hermann, Optics of Charged Particles, Orlando: Academic Press, 1987, pp. 201-205.

Wollnik, Hermann, Focusing of Charged Particles, vol. 2, Albert Septier, ED, New York; Academic Press, 1967, pp. 163-202 (Chapter 4.1).

* cited by examiner

ELECTRIC SECTOR TIME-OF-FLIGHT MASS SPECTROMETER WITH ADJUSTABLE ION OPTICAL ELEMENTS

CROSS-REFERENCE TO RELATED APPLICATION

This application is a continuation of U.S. pat. application Ser. No. 10/758,326, filed Jan. 14, 2004, now U.S. Pat. 6,998,606, issued Feb. 14, 2006, which is a continuation of U.S. patent application Ser. No. 10/424,351, filed Apr. 24, 2003, now U.S. Pat. No. 6,867,414, issued Mar. 15, 2005, which claims the benefit of U.S. provisional patent application Serial No. 60/413,406, filed Sep. 24, 2002, The entire disclosures of these applications are incorporated herein by reference.

FIELD OF THE INVENTION

This invention is in the field of chemical and biochemical analysis, and relates particularly to apparatus and methods for detecting analytes with improved resolution and sensitivity by time-of-flight mass spectrometry.

BACKGROUND OF THE INVENTION

Time-of-flight (TOF) mass spectrometry has undergone impressive developments since its conception in 1946. Currently, TOF mass spectrometry is a widely used technique, having found particular utility for determining the molecular masses of large biomolecules. Since mass analysis by TOF mass spectrometry does not require time-dependent changing magnetic or electric fields, mass analysis can be performed in a relatively small time window for a wide range of masses.

In its simplest form, a TOF mass spectrometer comprises at least three major components: an ion source, a free-flight region, and an ion detector. In the ion source, molecules from the sample are converted to volatile ions, usually by high-energy bombardment. Each ion is characterized by its mass-to-charge ratio, or m/z. Therefore, from a sample that comprises molecules of different masses, the ion source generates a plurality of ion species, each species having a characteristic m/z.

Following ionization, ions of the appropriate polarity are accelerated to a final velocity by an electric field and enter the free-flight region. This acceleration and extraction imparts an approximately constant kinetic energy to each of the ions. Consequently, each ion acquires a final velocity after acceleration that is inversely proportional to the square root of its mass. Accordingly, lighter ions have a higher velocity than heavier ions.

During free-flight, ions of different masses separate as a consequence of their different velocities. After traversing the free-flight region, the ions arrive at the ion detector component. The time taken by an ion to traverse this distance, known as the time-of-flight (TOF), may be used to calculate the mass of the ion. In this manner, a time-of-flight spectrum may be converted into a mass spectrum of the original sample.

Ions having exactly the same mass and kinetic energy traverse the free-flight region as a highly compact parcel. This parcel arrives at and is recorded by the ion detector as having essentially a single TOF for all of the ions therein. In this optimal scenario, mass determination is highly accurate and sensitive, as is the ability to distinguish different ions of similar mass, a property known as mass resolution.

In practice, however, it is difficult to achieve these optimal circumstances using a TOF mass spectrometer. Several stochastic factors conspire to impart a distribution of energies to the ions formed in the ion source. This distribution may arise due to inhomogeneities among the ions during their initial formation, such as differences in their thermal energies, velocities, spatial positions, or times of formation. As a result, parcels of identical ions disperse in the free-flight region and hence arrive at the ion detector with a broader distribution of times-of-flight. This broader distribution decreases the accuracy, sensitivity, and resolution of the mass spectrum. Consequently, the resulting mass spectrum is one in which an accurate determination of ionic masses is difficult, as is the ability to resolve ions of similar but non-identical masses as a result of overlapping signals. These problems have imposed serious limitations on the accuracy and utility of TOF mass spectrometers.

Various techniques, known generally as ion focusing, have been described that attempt to offset this mass-independent dispersion of ions during free-flight. Some of these focusing techniques, such as time-lag focusing, post-source focusing, and dynamic pulse focusing, manipulate the electric field during ion acceleration. Other methods include ion mirrors or reflectrons that provide ion focusing by altering the flight path length, such that higher energy ions are made to travel proportionally longer paths. However, these techniques are limited to focusing ions in a limited mass range.

Another ion focusing technique uses curved deflecting fields provided by electric sectors. U.S. Pat. No. 3,576,992 (Moorman, et al.) and U.S. Pat. No 3,863,068 (Poschenrieder) describe ion focusing techniques using electric sectors. Electric sectors comprise curved pairs of electrostatic plates with a deflecting electric field therebetween. Ions enter the electric sector and are deflected by the electric field to follow a curved path therein before exiting. Ion focusing occurs because ions of different energies follow different paths within the electric sector. Higher energy ions follow a longer curved path with a lower angular velocity than lower energy ions. Consequently, the higher energy ions require more time to traverse the electric sector than the lower energy ions, a trend that is opposite to and hence offsets the dispersion and loss of mass resolution in the linear free-flight region. With appropriate distribution of the ion flight path between the electric sector and the free-flight region, ion focusing may result in a TOF mass spectrum with a higher mass resolution and sensitivity.

A further enhancement is described in Poschenrieder and other references (T. Sakurai, et al., "Ion Optics For Time-Of-Flight Mass Spectrometers With Multiple Symmetry", *Int. J Mass. Spectrom. Ion Proc.* 63, pp 273-287 (1985); T. Sakurai, et al., "A New Time-Of-Flight Mass Spectrometer", *Int. J. Mass. Spectrom. Ion Proc.* 66, pp 283-290 (1985)). A plurality of electric sectors are arranged in series, each sequentially deflecting and focusing a single ion flight path. This arrangement also allows for multiple free-flight regions that may precede and follow each of the electric sectors. Furthermore, the multiple electric sectors may be arranged in a compact, symmetric arrangement that provides for improved energy and spatial focusing. The compact nature is a further advantage since the total length of the ion flight path may be contained within a space of significantly smaller dimensions, thereby conserving valuable space within the apparatus.

Although certain advantages of electric sectors in TOF mass spectrometry have been demonstrated, their use remains limited due to several disadvantages. For one, the ion focusing abilities of an electric sector are highly dependent on and sensitive to its electric field properties and physical parameters. Small deviations in these parameters can profoundly affect its ion focusing abilities. Hence, electric sectors are difficult to construct and install in order to achieve the desired results. Furthermore, modifying or correcting these parameters by mechanical means after their construction and installation is also exceedingly difficult.

Accordingly, it is desirable to provide apparatus and methods for performing TOF mass spectrometry with ion focusing electric sectors to improve the mass resolution and/or the sensitivity of mass spectra.

It is also desirable to provide apparatus and methods for performing TOF mass spectrometry with ion focusing electric sectors such that the ion focusing properties of the electric sectors are easily adjustable, thereby allowing tuning of the TOF mass spectrometer to improve mass resolution or sensitivity.

SUMMARY OF THE INVENTION

The present invention solves these and other needs by providing a time-of-flight mass spectrometer with one or more electric sectors. At least one of the electric sectors is associated with one or more ion optical elements. The ion optical elements are disposed at either or both the entry or the outlet of the electric sector, such that the optical element modifies the potential experienced by an ion entering or exiting the electric sector with which it is associated. Each ion optical element comprises at least one trim electrode, wherein the potential of the trim electrode is adjustable. Furthermore, each trim electrode may be independently adjustable with respect to others of the adjustable trim electrodes and the electric sectors. Therefore, each adjustable trim electrode may provide an additional degree of freedom with which to modify the ion focusing properties of the electric sectors without requiring the more difficult mechanical adjustment or modification of the electric sectors themselves.

In another embodiment of the present invention, a TOF mass spectrometer further comprises a plurality of electric sectors in a symmetric arrangement. This arrangement of electric sectors deflects the ions into a correspondingly symmetric flight path, thereby providing additional ion focusing abilities in a compact space. At least one of the electric sectors is associated with one or more ion optical elements. Each ion optical element comprises at least one independently adjustable trim electrode as described above.

In another aspect, methods are provided that allow tuning of a TOF mass spectrometer of the present invention to improve the mass resolution or sensitivity of the resulting mass spectra. The tuning is performed by adjusting the adjustable trim electrodes of one or more of the ion optical elements present therein, thereby modifying the ion focusing properties of the mass spectrometer. Observing and comparing the effects of the adjustment on the mass spectrum may be used to guide further trim electrode adjustments until a desired mass spectrum in achieved.

The present invention provides a time-of-flight mass spectrometer comprising ion flight path means defining a flight path for ions and having an ion entrance and an ion exit, an ion source including means for accelerating a pulse of ions from the ion source into the ion entrance of the ion flight path means, an ion detector in communication with the ion exit of the ion flight path means, and means for recording a time-of flight spectrum of the detected ions. The ion flight path means comprises at least one field free region; at least one electric sector, each electric sector having an entry and an outlet; and at least one ion optical element associated with at least one electric sector, wherein each ion optical element modifies the potential experienced by an ion entering or exiting an electric sector.

In certain embodiments of the present invention, the ion optical element may comprise an Einzel lens and/or at least one adjustable trim electrode that adjustably modifies the potential experienced by an ion entering or exiting an electric field. The adjustable trim electrode may be disposed between the entry and the outlet of the electric sector. Typically, the trim electrodes may comprise a pair or a plurality of pairs of trim electrodes, wherein each pair of trim electrodes is associated with either an entry or an outlet of an electric sector. The pair of trim electrodes may be disposed so that the ions pass between the two trim electrodes.

In certain embodiments, the mass spectrometer may comprise a plurality of electric sectors, preferably four electric sectors, wherein a field-free region separates each electric sector. Typically, each electric sector has a deflection angle of about 270 degrees. The mass spectrometer may comprise a field-free region before the first electric sector and after the last electric sector.

In certain embodiments, a mass spectrometer of the present invention comprises a plurality of electric sectors, wherein the adjustable trim electrode comprises a first and second pair of adjustable trim electrodes, each pair disposed such that the ions pass between the adjustable trim electrodes of the pair, wherein the first pair is associated with the entry of the electric sector closest to the ion entrance of the ion flight path and the second pair is associated with the outlet of the electric sector closest to the ion exit of the ion flight path.

In certain embodiments, the ion source may include laser desorption/ionization means, chemical ionization means, electron impact ionization means, photoionization means, or electrospray ionization means. The ion source may also include means for selectively providing ions of one or more masses or range of masses, or fragments thereof, such as a quadrupole ion trap or a linear ion trap.

In certain embodiments, the means for accelerating the pulse of ions comprises a voltage pulse applied subsequent to the formation of the ions. The ion source may comprise means to extract a group of ions from a pulsed or continuous ion beam in a direction substantially perpendicular to the direction of the beam.

In certain embodiments, the mass spectrometer may comprise at least one Herzog shunt having an aperture, wherein the Herzog shunt is associated with either an entry or an outlet of an electric sector such that ions may pass through the aperture. In another embodiment, the mass spectrometer may comprise an enclosure enclosing at least one electric sector. The enclosure may include at least one aperture configured to function as a Herzog shunt.

In certain embodiments, the present invention further comprises a control system configured to adjust the trim electrodes wherein the adjustment adjustably modifies the potential experienced by an ion entering or exiting an electric sector. The control system may comprise a software program.

The present invention also provides a method for tuning a time-of-flight mass spectrometer. The method comprises providing a mass spectrometer of the present invention, determining the resolution or sensitivity of detection of ions at a first setting, determining the resolution or sensitivity of detection of ions at a second setting, and determining whether resolution or sensitivity of detection of ions is improved or degraded at the second setting. The resolution or sensitivity of ion detection at the first setting is determined by applying a potential to at least one adjustable trim electrode, obtaining a first mass spectrum of ions from the ion source, and determining resolution or sensitivity of detection from the first mass spectrum. The resolution or sensitivity at the second setting may be determined by adjusting the potential applied to at least one adjustable trim electrode, obtaining a second mass spectrum of ions from the ion source, and determining resolution or sensitivity of detection from the second mass spectrum.

If the resolution or the sensitivity is determined to be degraded at the second setting, the method may further comprise determining the resolution or sensitivity of detection of ions at a third setting and determining whether resolution or sensitivity of detection of ions is improved or degraded at the third setting. The resolution or sensitivity of the ion detection at the third setting may be determined by adjusting the potential applied to at least one adjustable trim electrode in a direction opposite to the adjustment of the second setting, obtaining a third mass spectrum of ion from the ion source, and determining the resolution or sensitivity of detection from the third mass spectrum.

If the resolution or the sensitivity is determined to be improved at the second setting, the resolution or sensitivity of detection of ions at the third setting may instead be determined by adjusting the potential applied to at least one adjustable electrode in a direction the same as the adjustment of the second setting, obtaining a third mass spectrum of ion from the ion source, and determining resolution or sensitivity of detection from the third mass spectrum.

BRIEF DESCRIPTION OF THE DRAWINGS

The above and other objects and advantages of the present invention will be apparent upon consideration of the following detailed description taken in conjunction with the accompanying drawings, in which like characters refer to like parts throughout, and in which.

DETAILED DESCRIPTION OF THE INVENTION

Definitions

Figure 1:
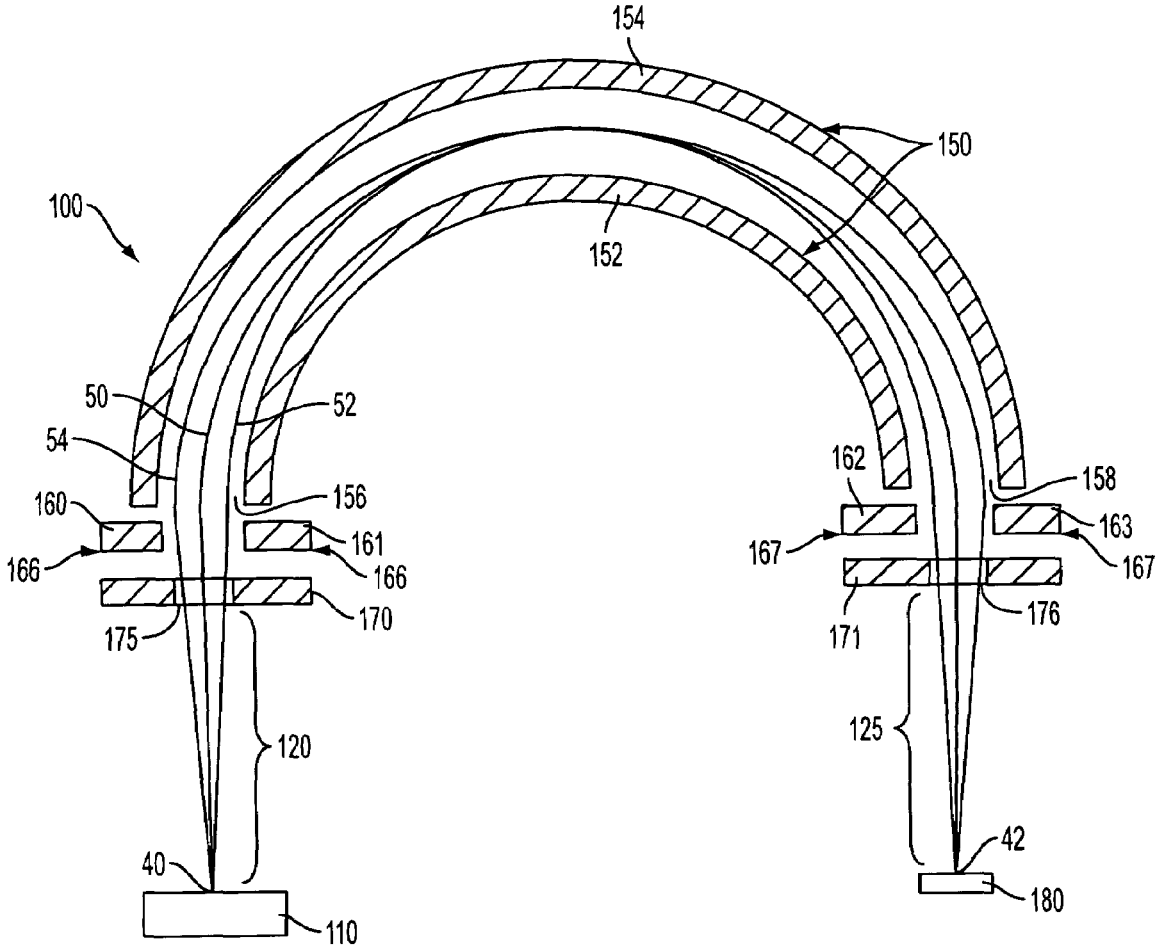
FIG. 1 is a schematic top cross-sectional view of an embodiment of the present invention.

As used herein, the terms set forth with particularity below have the following definitions. If not otherwise defined, all terms used herein have the meaning commonly understood by a person skilled in the arts to which this invention belongs.

"Ion source" refers to a component of the mass spectrometer that is suitable for generating and extracting a plurality of ions from a sample. Ion sources are indicated by reference number 110 in FIGS. 1 and 10 and reference number 210 in FIG. 3.

"Ion flight path" refers to the path taken by the ions within the mass spectrometer apparatus between the "ion entrance" and the "ion exit". Ion flight paths may be exemplified by the path followed by a reference ion, such as those indicated by reference numbers 50, 52, and 54 in FIGS. 1 and 10 and reference number 60 in FIG. 3.

"Ion flight path means" refers to the components of the mass spectrometer apparatus that define the ion flight path. Ion flight path means have an ion entrance and an ion exit, and may comprise at least one field-free region, at least one electric sector, and at least one ion optical element. Exemplary ion flight path means in FIGS. 1 and 10 comprise free-flight regions 120 and 125, electric sector 150, and ion optical elements 166 and 167. The ion flight path means of the embodiment depicted in FIG. 3 comprises free-flight regions 220, 222, 224, 226, and 228; electric sectors 250, 350, 450, and 550; and the ion optical elements associated with the electric sectors.

"Field free region" refers to a one or more segments of an ion flight path in which the ions are allowed to travel without linear or angular acceleration. Field free regions are indicated by reference numbers 120 and 125 in FIGS. 1 and 10 and by reference numbers 220, 222, 224, 226, and 228 in FIG. 3.

"Electric sector" refers to a component of the mass spectrometer apparatus that defines a curved deflection region of the ion flight path. The electric sector comprises two deflecting electrodes with an electric field therebetween that is configured to deflect ions such that the ions follow a curved path by angular acceleration. Electric sectors are illustrated in the drawings, e.g., by reference numbers 150, 250, 350, 450, and 550.

"Ion optical element" refers to a component of the mass spectrometer apparatus distinct from the electric sectors that is configured to modify the potential experienced by ions in the ion flight path. When the ion optical element is in association with an electric sector, the modification of the potential is imposed on the ions as the ions enter, exit, or pass through the electric sector. Ion optical elements are, e.g., indicated by reference numbers 166 and 167 of FIGS. 1 and 10 and by reference numbers 266 and 267 of FIGS. 3, 5A and 5B.

"Ion detector" refers to a component of the mass spectrometer apparatus that is suitable for detecting ions after exiting the ion flight path. The detection of the arriving ions is used to determine the time-of-flight of the ions. For illustration, ion detectors are indicated by reference number 180 in FIGS. 1 and 10 and by reference number 280 in FIG. 3.

"Trim electrode" refers to one or more components of an ion optical element that are configured to modify the potential experienced by ions on the ion flight path. The present invention includes trim electrodes that are adjustable. Illustrative trim electrodes are indicated by reference numbers 160-163 on FIGS. 1 and 10 and reference numbers 260-263 on FIGS. 3, 5A and 5B.

"Fragments" refers to ions that result from the decomposition of molecular ions. Fragments may be formed during or after ionization of the sample.

Figure 3:
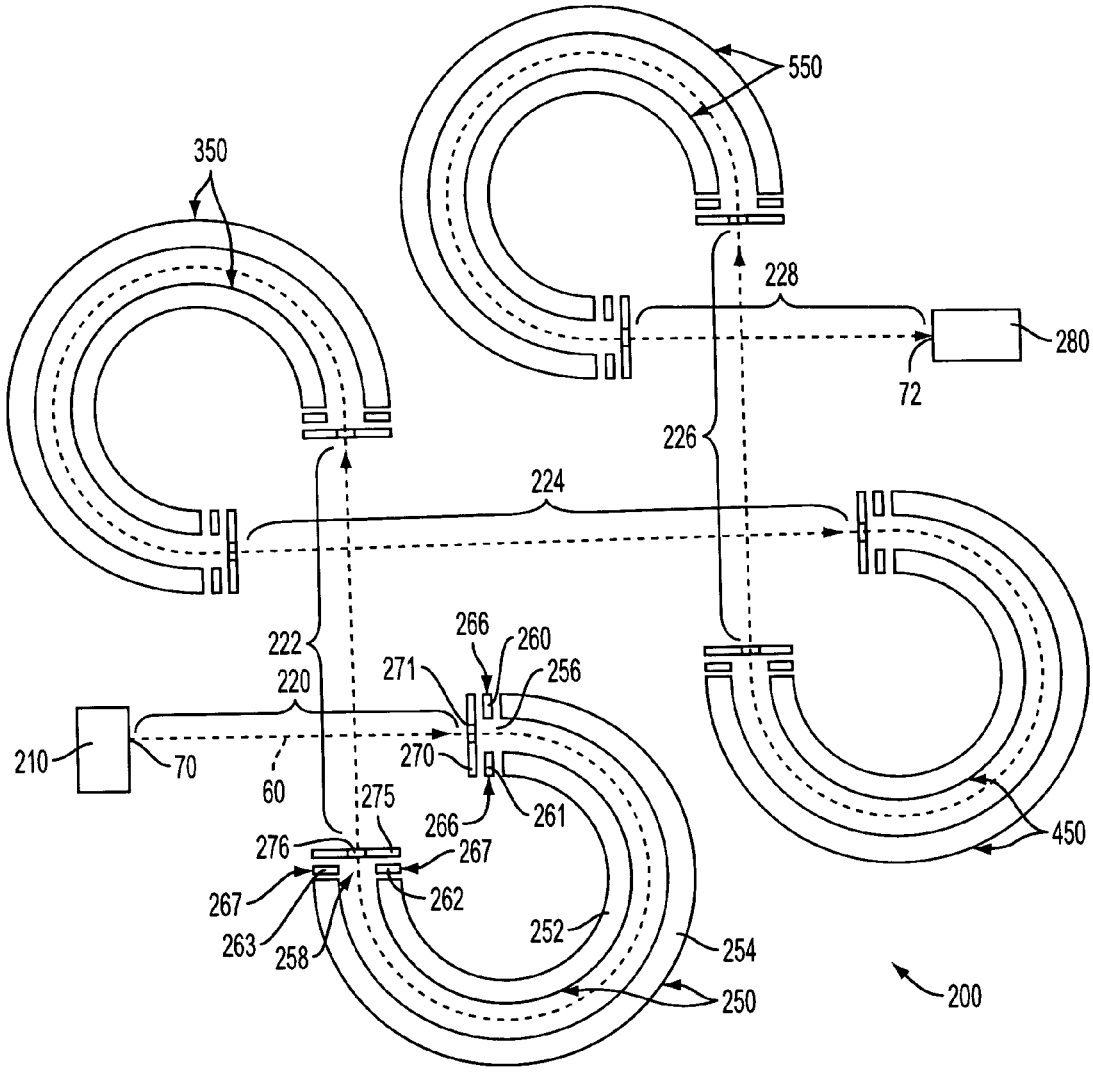
FIG. 3 is a schematic top cross-sectional view of another embodiment of the present invention.
Figure 10:
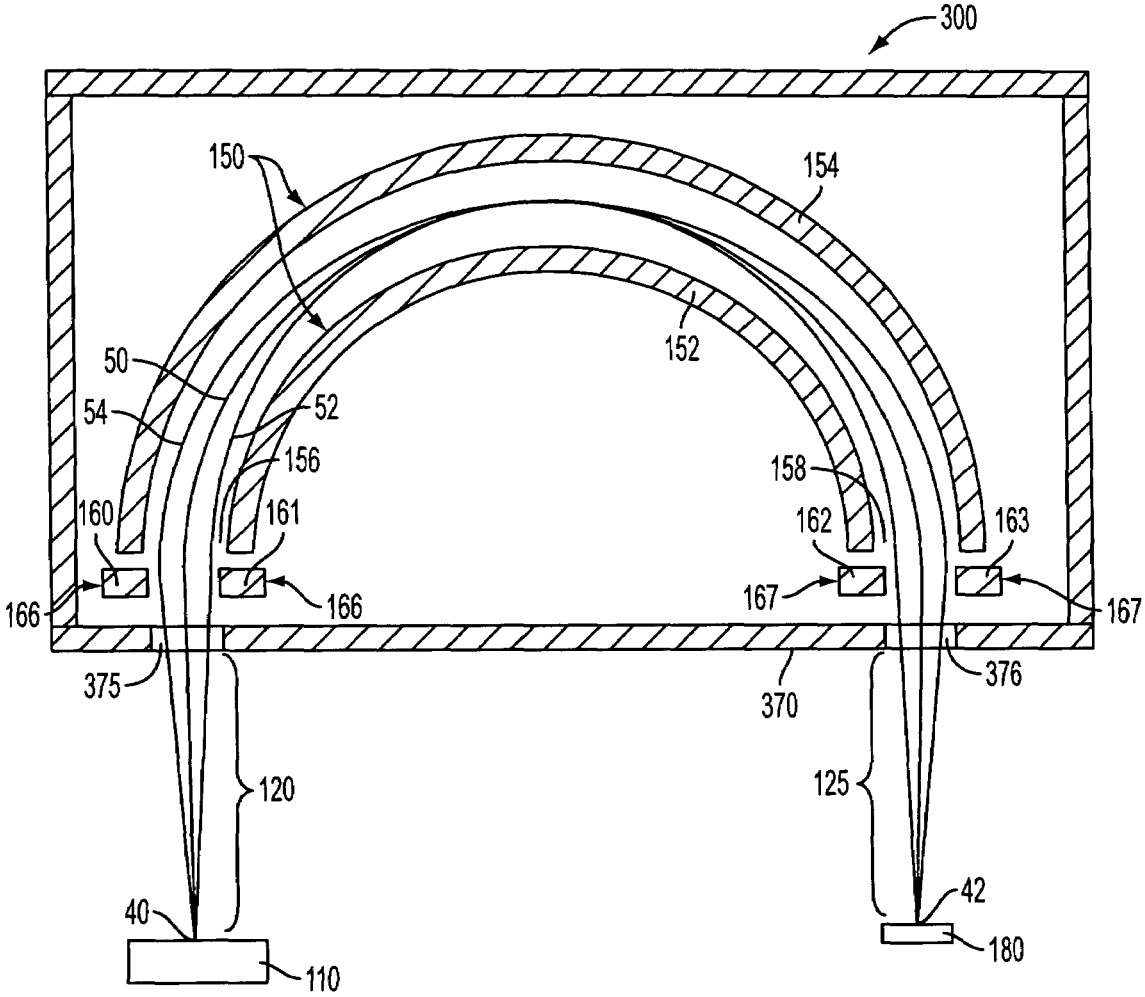
FIG. 10 is a schematic top cross-sectional view of another embodiment of the present invention.

"Deflection angle" refers to the angle spanned by the arc of the electric sector over which the ions on the ion flight path are deflected. For example, the deflection angle of the electric sector in FIGS. 1 and 10 is approximately 180° and the deflection angle of each electric sector in FIG. 3 is approximately 270°.

"Ion trap" refers to a component of the ion source that is suitable for trapping ions formed in the ion source prior to their extraction. Ion traps use electric fields configured to selectively trap and provide ions of one or more masses or range of masses, or fragments thereof. Ion traps may include quadrupole ion traps and linear ion traps.

"Herzog shunt" refers to a component or structure in a mass spectrometer apparatus suitable for limiting the terminal electric fields of an electric sector. A Herzog shunt has an aperture to allow passage of the ion flight path therethrough. Illustrative Herzog shunts are indicated by reference numbers 170 and 171 in FIGS. 1 and 10 and by reference numbers 270 and 275 in FIGS. 3, 5A and 5B. The enclosure and apertures indicated by reference number 370 and 375-376, respectively, on FIG. 10 also function as Herzog shunts.

"Einzel lens" is a component of an ion optical element that comprises one or more electrodes suitable for focusing the radial distribution of ions on the ion flight path.

"Resolution" refers to the ability to distinguish ions of similar but non-identical masses as separate signals and/or the width of a measured mass signal as a ratio of its determined mass.

"Sensitivity" refers to the ability to detect and distinguish signals over the noise of the spectrum, thereby establishing the minimum amount of sample required to detect a signal.

"Accuracy" refers to the ability of a calibrated mass spectrometer to provide a mass value for an ion that is close to the predicted mass for that ion.

"Spectral range" refers to the extent to which the spectrometer can detect and measure a range of masses and/or times-of-flight from a given sample within a single spectrum. Ions outside of the spectral range of a mass spectrum are usually not detectable.

DESCRIPTION OF THE PRESENT INVENTION

In the apparatus of the present invention, ion optical elements, comprising independently and readily adjustable trim electrodes, provide additional degrees of freedom for modifying the electrical potentials experienced by ions passing through an electric sector. In this manner, the ion focusing properties of the electric sectors are also independently and readily adjustable, without requiring the difficult mechanical modification or adjustment of the electric sectors themselves. As a result, the ion optical elements of the present invention significantly improve the performance of a TOF mass spectrometer apparatus and its methods of use.

Referring to FIG. 1, apparatus 100 comprises a TOF mass spectrometer in accordance with the present invention, shown in a top cross-sectional view. The cross-section is taken through a plane defined by flight path 50 of a reference ion traveling therethrough. Apparatus 100 comprises ion source 110, free-flight regions 120 and 125, electric sector 150, ion optical elements 166 and 167, Herzog shunts 170 and 171, and ion detector 180. During typical operation of the TOF mass spectrometer, ions are generated and accelerated in ion source 110, separate in free-flight region 120, pass through aperture 175 of shunt 170, pass between paired trim electrodes 160 and 161 of ion optical element 166, and enter electric sector 150 via entry opening 156. Outer and inner deflecting electrodes 154 and 152, respectively, provide a deflecting electric field therebetween that deflects the ions into a curved path. The ions then exit via outlet opening 158, pass between paired trim electrodes 162 and 163 of ion optical element 167, pass through aperture 176 of shunt 171, separate in free-flight region 125, and are detected on arrival at ion detector 180. Flight path 50 is the path of a reference ion, while flight paths 52 and 54 are schematic representations of the paths taken by ions leaving ion source 110 with angles which are slightly larger or smaller than the angle of the reference ion.

Accordingly, an ion flight path is defined within apparatus 100, for which flight path 50 is a representative example. Flight path 50 comprises ion entrance 40 at which ion source 110, in communication with free-flight region 120, causes the ions to enter flight path 50. Correspondingly, flight path 50 further comprises ion exit 42, at which the ions exit flight path 50 upon arrival at ion detector 180 which is in communication with free-flight region 125.

Ion source 110 includes means for generating ions that are known in the art, including any of the means or methods known in the art for producing a plurality of ions within a relatively small volume and within a relatively short time.

Also included are any of the means or methods known in the art for producing a pulse of ions, such that the pulse of ions has the appearance of or behaves as if the ions were produced within a relatively small volume and within a relatively short time. Ion source 110 may include means to form ions in a continuous or pulsed manner. The ion source may also include means to concentrate the ions, such as a quadrupole ion trap or a linear ion trap.

Ion source 110 may, e.g., include means that employ a pulsed laser interacting with a solid surface, a pulsed focused laser ionizing a gas within a small 10 volume, or a pulsed electron or ion beam interacting with a gas or solid surface. In another example, ion source 110 may employ means for generating a pulse of ions that uses a rapidly sweeping, continuous ion beam passed over a narrow slit, in which a brief pulse of ions is produced by the ions passing through the slit when the ion beam passes thereover. Ion source 110 may employ, but is not limited to use of, electrospray ionization, laser desorption/ionization ("LDI"), matrix-assisted laser desorption/ionization ("MALDI"), surface-enhanced laser desorption/ionization ("SELDI"), surface-enhance neat desorption ("SEND"), fast atom bombardment, surface-enhanced photolabile attachment and release, pulsed ion extraction, plasma desorption, multiphoton ionization, electron impact ionization, inductively coupled plasma, chemical ionization, atmospheric pressure chemical ionization, hyperthermal source ionization, and the like.

Furthermore, ion source 110 may also include means for selectively providing ions of one or more masses or ranges of masses, or fragments therefrom. Such means may be accomplished by combining a TOF mass spectrometer of the present invention in tandem fashion with a plurality of analyzers, including magnetic sector, electrostatic analyzer, ion traps, quadrupole ion traps, quadrupole mass filters, and TOF devices.

Ion source 10 also includes means for ion extraction or acceleration from the ion source to ion entrance 40 of the ion flight path. The extraction methods may be parallel or orthogonal to the ion beam generated in ion source 110. In addition, extraction or acceleration of the ions may occur subsequent to the formation of the ions, such as by application of a voltage pulse.

Likewise, ion detector 180 includes means for detecting ions and amplifying their signals that are known, and also will not be discussed in detail here. For example, ion detector 180 may include continuous electron multipliers, discrete dynode electron multipliers, scintillation counters, Faraday cups, photomultiplier tubes, and the like. Ion detector 180 may also include means for recording ions detected therein, such as a computer or other electronic apparatus.

Figure 2:
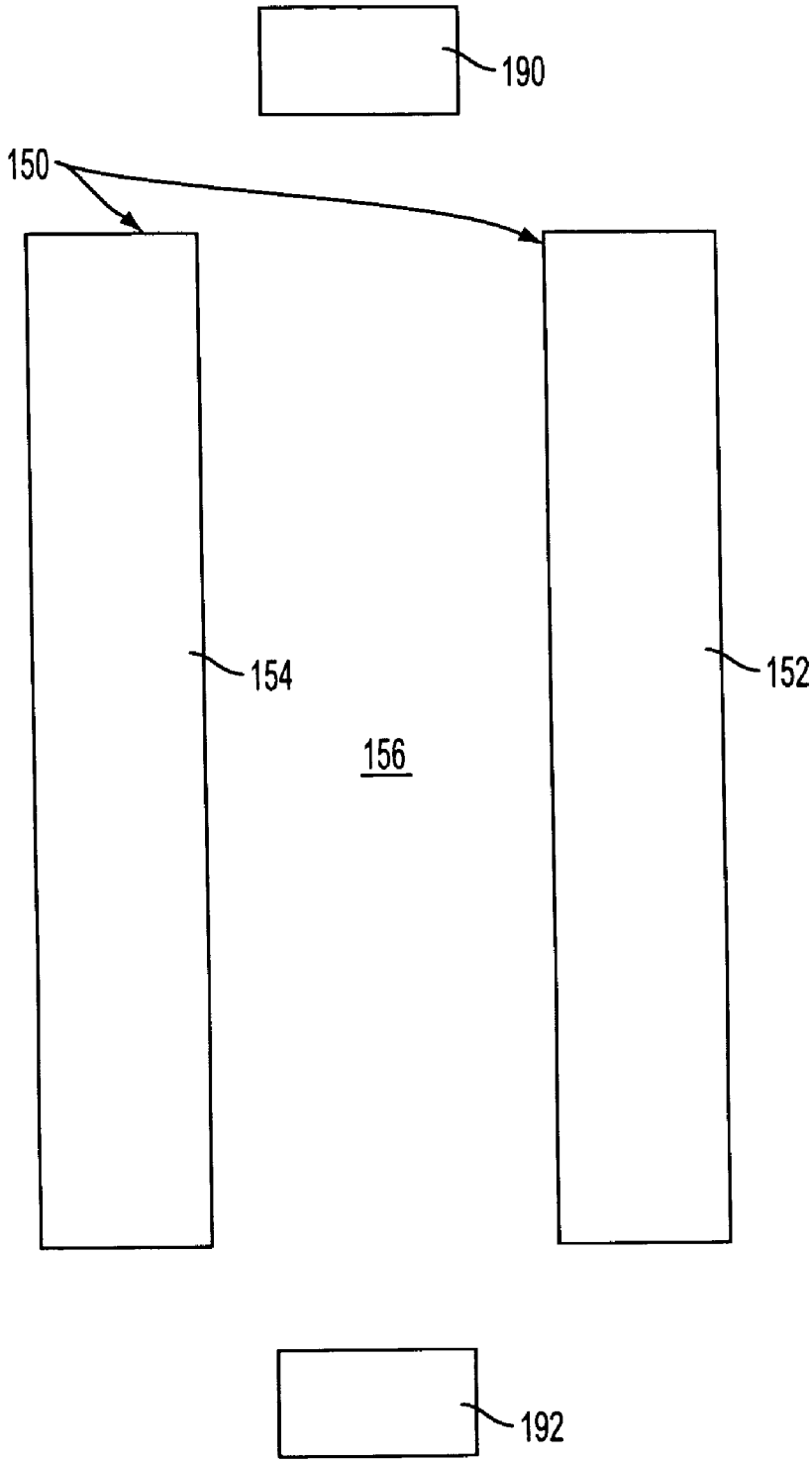
FIG. 2 is a schematic view of an electric sector opening of the present invention with the reference ion flight path normal to the plane of the drawing.

Electric sector 150 comprises inner deflecting electrode 152 and outer deflecting electrode 154. Referring to FIG. 2, a view of entry opening 156 of electric sector 150 is shown, such that the ion flight path is approximately normal to the plane of the figure. As shown, the electric sector further comprises top and bottom Matsuda plates 190 and 192, respectively. In the preferred embodiment, both deflecting electrodes are cylindrical sections with outer electrode 154 having a larger radius than inner electrode 152. Alternatively, the electrostatic plates may conform to other forms, such as toroidal or spherical sections. Further alternative embodiments include electrostatic plates in which the radii of the inner and outer plates are substantially the same and hence converge at the top and bottom, such as when toroidal sections are employed. Matsuda plates 190 and 192 are themselves electrodes which are configured to further confine ions traversing electric sector 150 by preventing ions from exiting the top or bottom of the electric sector, thereby increasing the ion transmission yield of the electric sector.

Referring again to FIG. 1, entry Herzog shunt 170 and outlet Herzog shunt 171 are disposed at the respective openings of electric sector 150. These Herzog shunts are electrodes that have potentials that are approximately the same as the average potential within the electric sector. The purpose of the Herzog shunts, as is known in the art, is to terminate the electric field of the electric sector as near as possible to its openings, thereby approaching an ideal deflection field. Furthermore, as ions pass through apertures 175 and 176 of the Herzog shunts, the apertures serve to select for a narrower range of ion trajectories as the ions enter and exit the electric sector. It is preferred that the shape of Herzog shunt apertures 175 and 176 conform to the shape of the electric sector opening with which they are associated. For example, in embodiments in which inner electrode 152 and outer electrode 154 are cylindrical sections, a preferred shape of the Herzog shunt aperture associated with entry opening 156 or outlet opening 158 is conformally rectangular in shape. It is also preferred that the aperture of a Herzog shunt have smaller dimensions than the electric sector entry opening or outlet opening with which the shunt is associated.

Ion optical element 166 is associated with electric sector 150, being disposed at entry opening 156. Similarly, ion optical element 167 is disposed at outlet opening 158. Ion optical element 166 comprises a pair of trim electrodes 160 and 161; similarly, element 167 comprises trim electrodes 162 and 163. Both pairs of trim electrodes allow flight path 50 to pass between the paired trim electrodes. It is preferred that the pair of trim electrodes of a given ion optical element be separated by a distance that is less than the separation of the inner and outer electrodes of the electric sector entry or outlet with which the ion optical element is associated. Each trim electrode has an electric potential that may be independently adjustable with respect to others of the adjustable trim electrodes, as well as with respect to deflecting electrodes 152 and 154. Thus, each adjustable trim electrode provides an additional degree of freedom with which to adjust the ion focusing properties of electric sector 150.

As with the Herzog shunt apertures, it is preferred that the inner edges of the trim electrodes conform to the shape of the electric sector opening with which they are associated. For example, in the embodiment illustrated in FIG. 1, the inner edge of trim electrode 160 preferably conforms to the shape of the inner edge of outer deflecting electrode 154. The inner edges of the other trim electrodes are correspondingly conformal to their respective electric sector openings.

In embodiments in which a pair of trim electrodes (forming an ion optical element) and a Herzog shunt are associated with a given electric sector opening (entry or outlet), it is preferred that the separation of the inner and outer electric sector electrodes is greater than the distance separating the pair of trim electrodes, as described above. Moreover, it is also preferred that the separating distance between the trim electrodes is, in turn, greater than the width of the Herzog shunt aperture associated therewith.

Ion optical elements of the present invention comprising trim electrodes provide a means for modifying the potential experienced by ions in the ion flight path as the ions exit or enter an electric sector. Trim electrodes of the present invention provide a means for providing an adjustable potential. For example, by positioning ion optical elements 166 and 167 with respect to the openings of electric sector 150 and ion flight path 50 in the manner illustrated, each element is able to affect the potential experienced by an ion as it enters or exits electric sector 150. Accordingly, adjusting the potential of an ion optical element correspondingly modifies the potential experienced by the ion. These adjustments may be performed without adjusting the potential of Herzog shunts 170 and 171 or deflecting electrodes 152 and 154. In this manner, subtle adjustments may readily and advantageously be made to the ion optical properties of electric sector 150 without requiring direct adjustments to the electric sector itself. Examples of advantages provided by the ion optical elements are described below.

The ion optical elements of the present invention may be used to modify the deflection angle of electric sector 150 without significant effect on its other ion optical properties. Electric sectors of the prior art time-of-flight mass spectrometers do not include any means to modify selectively or specifically the potential experienced by an entering or exiting ion. Changing the potential of either deflecting electrode 152 or 154 changes the ion optical properties of the entire electric sector, and hence is not specific for the electric field at either entry opening 156 or outlet opening 158. More specifically, adjusting deflecting electrodes 152 or 154 would have a significant effect on the ion focusing properties and the energy range that the electric sector is configured to select. Adjusting ion optical elements 166 and 167 of the present invention to provide increased or decreased deflection of the ions allows for more subtle and more readily made adjustments to the deflection angle without significantly altering the other properties of the electric sector.

Another advantage provided by the ion optical elements of the apparatus of the present invention is to alter the ion focusing properties of electric sector 150. For example, adjusting ion optical element 167 (by applying equal, non-zero potentials to trim electrodes 162 and 163) at exit opening 158 may be used to alter the location of the point at which ions with flight paths similar to flight path 54 and flight path 52 cross or intersect near flight path exit 42. Such changes to the flight paths may result in changes to the ion focusing properties of electric sector 150 and improvements to the sensitivity and/or resolution of the time-of-flight mass spectrum.

The present invention provides at least two types of advantages. The first advantage results from the use of the ion optical elements of the present invention to correct or alter the performance of the associated electric sectors in TOF mass spectrometers so that the electric sectors have the ion optical properties expected from the design specification. The use of the ion optical elements in this manner may compensate for errors, defects, or deviations in fabrication or mechanical design of the electric sectors. The second advantage results from the use of combinations of ion optical properties that are not available with electric sectors which lack the present invention. In addition, because these properties are adjustable, the performance of TOF mass spectrometers incorporating the present invention may actually exceed the theoretical performance of designs based on conventional electric sectors.

For example, increasing the potential on each of the four trim electrodes described above by the same magnitude may result in changing the focusing of the ions in the radial plane. In another example, a small deflection of the ion beam may be applied at the entrance of the electric sector using a first ion optical element and an opposite deflection may be applied at the exit using a second ion optical element. Although this particular adjustment results in no change in the net deflection over the electric sector, the path taken by the ions through the electric sector is slightly altered. As a result, the overall performance of the TOF mass spectrometer of the present invention may be changed because of the change in the effective path length within the electric sector with respect to the path length through the field free (e.g., free-flight) regions.

Other applications and advantages arising from adjusting the potentials on the trim electrodes of the present invention may be envisioned by one of ordinary skill in this art, and such applications and advantages are within the scope of the present invention. Although the precise nature of all of the effects of the trim electrode potentials and adjustments thereof on the ion optical properties of the electric sector may not be fully explored at this time, we have demonstrated that by adjusting the potentials of the trim electrodes, the resolution and other properties of a TOF mass spectrometer of the present invention can be greatly improved compared to prior art devices.

Providing an adjustable potential field using an ion optical element of the present invention may be accomplished by using one or more trim electrodes that conforms to a physical shape corresponding to the shape of the potential. Trim electrodes of the present invention may also provide adjustable potentials of similar or equivalent shape without requiring the trim electrode to have the corresponding physical shape. Such electrodes may be fabricated from, for example, semiconductive or poorly conductive material, or insulative material fully or partially coated with conductive or semiconductive material. The foregoing conductive or semiconductive material may be formed as, for example, films or wires. It is understood that trim electrodes of any shape which produce the desired adjustable potentials are within the scope of this invention.

Ion optical elements of the present invention need not be limited to a single pair of trim electrodes. For example, a plurality of three or more trim electrodes may be positioned at the entry or outlet of an electric sector such that they compose an ion optical element. Such a plurality of trim electrodes may be arranged with trim electrodes in opposing pairs, in a point-symmetric arrangement, or any other suitable arrangement. Additional trim electrodes in an ion optical element configured in the foregoing manner not only provide additional degrees of freedom for modifying the potential experienced by the ions, but may also provide additional advantages. For example, additional trim electrodes may allow the operator to deflect the ions entering or exiting the electric sector associated therewith in a direction perpendicular to the plane of the electric sector and overall ion flight path. Trim electrodes used for perpendicular deflection may have edges that do not necessarily conform to the shape of the electric sector deflection electrodes, nor is it necessary that trim electrodes of the present invention conform to any particular shape.

Although ion optical elements of the present invention are disposed at both the entry and the outlet of the associated electric sectors of the preferred embodiment, other configurations and arrangements of ion optical elements with respect to electric sectors are within the scope of the invention.

The trim electrodes of an ion optical element are preferably positioned close to their associated electric sector entry or outlet, while maintaining a spacing with respect to the deflection electrodes sufficient to sustain the potential differences required by the design of the apparatus. Similarly, a Herzog shunt is also preferably positioned closely to its associated ion optical element and electric sector. In the preferred embodiment, the spacing between the Herzog shunt and the trim electrodes is the same as the spacing between the trim electrode and the electric sector opening. However, variations in the positions of the foregoing components, resulting in different spacings or different spacing ratios, are within the scope of the present invention. For example, the distance between the trim electrodes and the electric sector, or between the Herzog shunt and the trim electrodes, may be increased without departing from the spirit of the present invention. Also, the position of the trim electrodes may be moved arbitrarily close to the entrance or exit of an electric sector. In fact, the trim electrodes may even be moved into the region between the deflection electrodes of the electric sector. Those skilled in the art will recognize that all such variations in trim electrode geometry provide a means for modifying the potential experienced by ion in the ion flight path as the ions exit or enter an electric sector, and hence are within the scope of the present invention.

In the preferred embodiment, the thicknesses of the trim electrodes of a given ion optical element are less than the spacing separating the trim electrodes. However, the dimensions of the trim electrodes may be varied from this embodiment over a wide range while remaining within the scope of the present invention. For example, the thickness of the trim electrodes may be increased to a point where the distance traveled by an ion through the ion optical element is greater than the separation spacing of the trim electrodes or even the separation spacing of the electric sector. In the preferred embodiment, the thickness of the trim electrodes is approximately the same as that of the associated Herzog shunt. Again, deviations from this relationship are within the spirit of the present invention.

Electrodes of the present invention, including the deflecting electrodes, trim electrodes, Herzog shunts and Matsuda plates are made from materials known in the art. In general, suitable materials for the electrodes would include metals, metal alloys, composites, polymers, ionic solids, and combinations or mixtures thereof upon which a voltage may be applied from an external source. Electrodes of the present invention may be made from materials that are conductive, semiconductive, and/or poorly conductive. Electrodes may also be made from insulating material that has been coated with or supports a conductive, semi-conductive, or poorly conductive material, such as films, wiring, or the like.

As described above, ion optical elements and trim electrodes of the present invention may each have different and independent characteristics, such as with respect to their material composition, configuration, arrangement, shape, disposition with respect to electric sectors and other electrodes, etc. Accordingly, it is understood that any suitable combination of ion optical elements and trim electrodes having different or similar characteristics may be implemented within a TOF mass spectrometer and hence are within the scope of this invention.

With respect to FIG. 3, the preferred embodiment of a TOF mass spectrometer of the present invention is schematically illustrated in a top cross-sectional view. The cross-section is taken through a plane defined by reference ion flight path 60. Apparatus 200 is a TOF mass spectrometer comprising four identical electric sectors 250, 350, 450, and 550, each defining a curved deflection field of approximately 270° of arc. Each of the four electric sectors are preceded and followed by a free-flight region, namely 220, 222, 224,226, and 228. This symmetrical arrangement of the electric sectors and free-flight regions provides several advantages, including both isochronous and spatial focusing, as described in Sakurai, et al., "Ion Optics For Time-Of-Flight Mass Spectrometers With Multiple Symmetry", *Int. J. of Mass Spectrom. Ion Proc.* 63, pp 273-287 (1985). This symmetric arrangement also provides the advantage of allowing a relatively long flight path 60 to be compactly contained within a space of significantly smaller dimensions, thereby allowing the overall size of the mass spectrometer to decrease. In the preferred arrangement, each of the four electric sectors is positioned such that the plane defined by each sector is approximately parallel to and coplanar with those of the other sectors, while accommodating the free-flight regions therebetween.

Apparatus 200 further comprises ion source 210 and ion detector 280, both of which are functionally analogous to the corresponding features in apparatus 100 illustrated in FIG. 1. Likewise, each of electric sectors 250, 350, 450, and 550 comprises essentially the same elements as the others and has essentially the same functions as electric sector 150 described above. Hence, reference will only be made to the elements of electric sector 250, with the understanding that the following descriptions apply to the other electric sectors.

During typical operation of apparatus 200, sample-derived ions are generated in and extracted from ion source 210, separated and focused along flight path 60, and are finally detected upon arrival at ion detector 280. Flight path 60 comprises ion entrance 70 and ion exit 72, and is defined by the four electric sectors (250, 350, 450, and 550) and the five free-flight regions (220, 222, 224, 226, and 228), which are arranged as shown and each of which communicates with its neighbors. Ions enter flight path 60 via ion entrance 70 by exiting ion source 210 and entering free-flight region 220. Correspondingly, ions exit flight path 60 via ion exit 72 by entering ion detector 280 from free flight region 228.

In the preferred embodiment of apparatus 200, the lengths of the free-flight regions are defined by parameters designated "D1" and "D2," values for which are listed in Tables 1 and 3. In the preferred embodiment, the lengths of free-flight regions 222 and 226 are substantially the same length, wherein this length is two times "D2." It is also preferred that the length of free-flight region 224 is substantially two times the length of free-flight regions 220 and 228, wherein the lengths of free-flight regions 220 and 228 are defined by "D1." However, it would be understood by one skilled in the art that these default lengths may be further adjusted and/or modified to alter the performance or other desired characteristics of the apparatus. For example, the lengths of free-flight regions 220 and 228, which are associated respectively with the ion source 210 and ion detector 280, may be modified from the default lengths described above depending on the actual ion source and/or ion detector used in the apparatus.

First electric sector 250 comprises inner deflecting electrode 252 and outer deflecting electrode 254. Entry opening 256 of the electric sector is associated with Herzog shunt 270 having aperture 271. Similarly, Herzog shunt 275 with aperture 276 associates with the electric sector at outlet opening 258.

Also associated with entry 256 and outlet 258 are ion optical elements 266 and 267, respectively. Ion optical element 266 comprises trim electrodes 260 and 261, and similarly ion optical element 267 comprises trim electrodes 262 and 263. In this particular embodiment, electric sectors 350, 450, and 550 comprise the same elements as electric sector 250, and hence will not be discussed separately.

Figure 4:
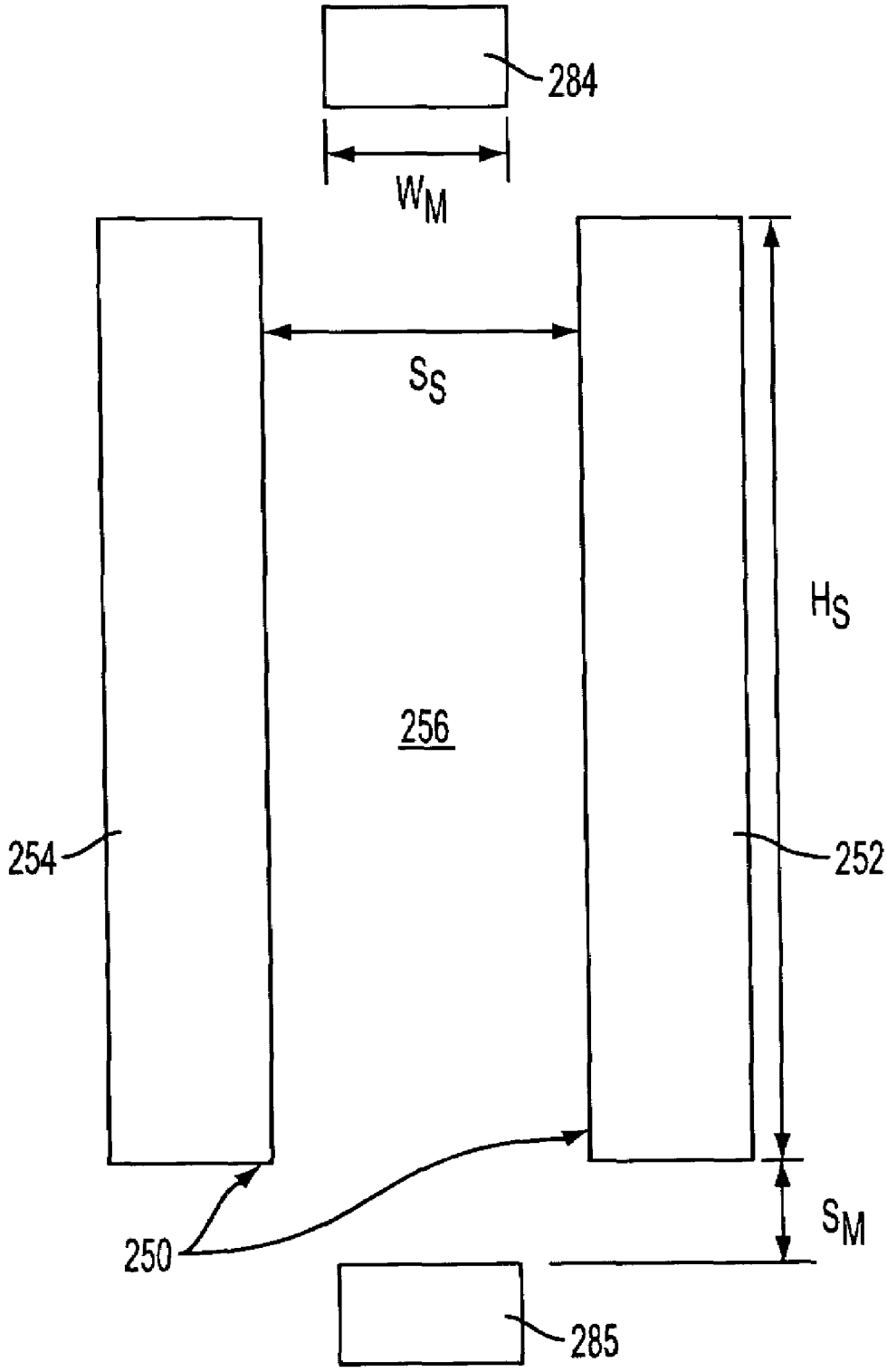
FIG. 4 is a schematic view of an electric sector opening of the present invention with the reference ion flight path normal to the plane of the drawing and with dimensions labeled.

FIG. 4 shows a schematic drawing of entry 256 to electric sector 250 of FIG. 3, such that a reference ion flight path is approximately normal to the plane of the figure. This figure defines the dimensions $S_S$, the space between the inner deflecting electrode 252 and the outer deflecting electrode 254 of electric sector 250; $W_M$, the width of the Matsuda plates 284 and 285; $H_S$, the height of the electric sector deflecting electrodes 252 and 254; and $S_M$, the spacing between the Matsuda plates 284 and 285 and the electric sector deflecting electrodes 252 and 254.

Figure 5A:
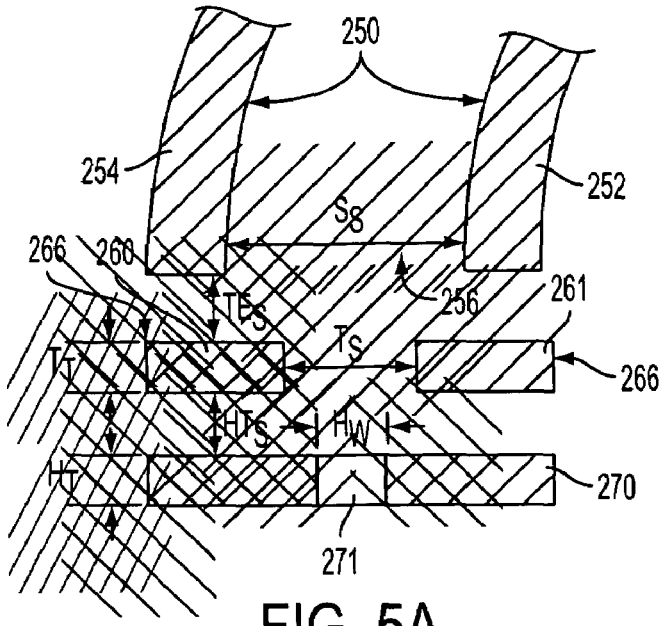
FIGS. 5A and 5B are a schematic top cross-sectional view and an exploded isometric view, respectively, of an electric sector opening of the present invention.

FIG. 5A shows a top cross-sectional view of electric sector entry 256 to electric sector 250, including inner deflecting electrode 252 and outer deflecting electrode 254. The Matsuda plates shown in FIG. 4 are omitted for illustrative purposes. Also depicted in this view are ion optical element 266 (including trim electrodes 260 and 261) and Herzog shunt 270 (including Herzog shunt aperture 271). Various dimensions, values for which are listed in Tables 1 and 3 (see below), are labeled in this view. These dimensions include the trim electrode thickness ($T_T$), the trim electrode spacing ($T_S$), the trim electrode to deflecting electrode space ($TE_S$), Herzog shunt thickness ($H_T$), Herzog shunt spacing to trim electrode ($HT_S$), Herzog shunt opening height ($H_H$) and Herzog shunt opening width ($H_W$).

Figure 5B:
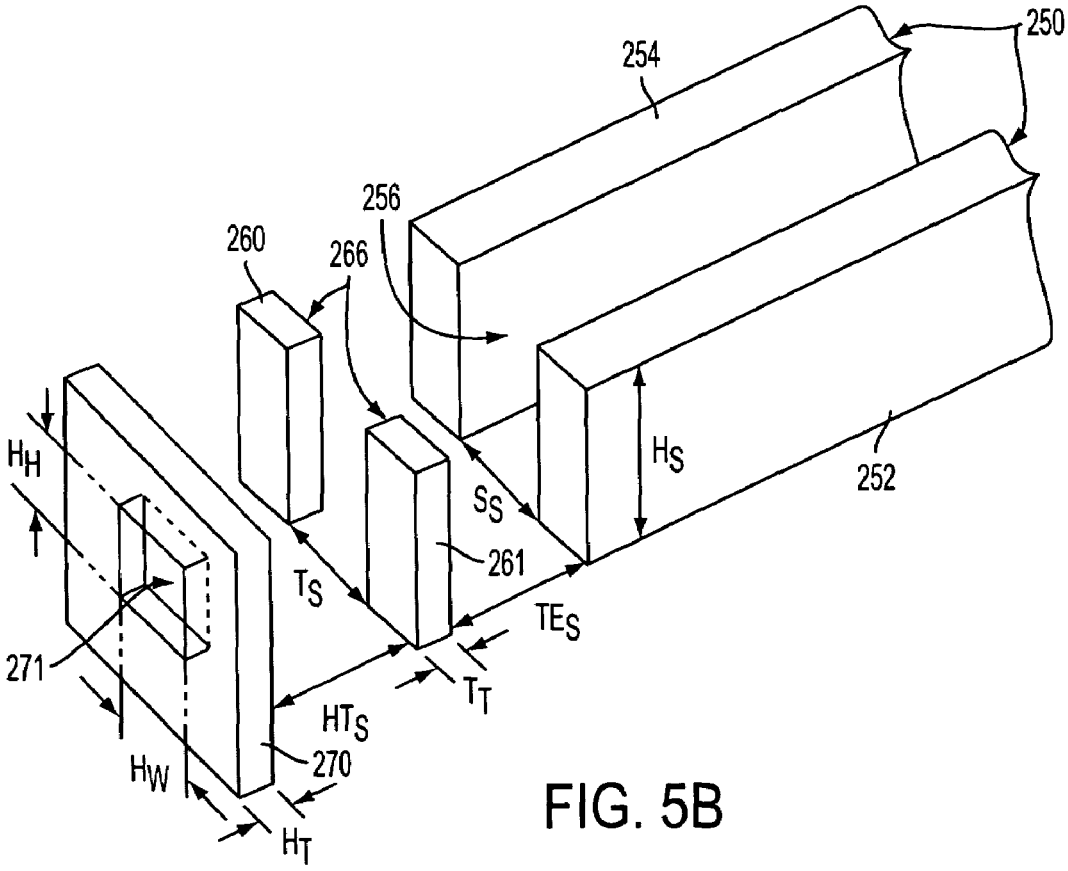

FIG. 5B shows a corresponding exploded isometric view of entry 256 to electric sector 250, with various dimensions labeled, values for which are listed in Table 1 and 3 (see below). As with FIG. 5A, values for these dimensions are considered representative of all four electric sectors depicted in FIG. 3. All dimensions are given in inches, unless otherwise indicated.

In various embodiments, the ion optical elements may include an Einzel lens. As is known in the art, an Einzel lens comprises multiple electrodes configured to focus the ion beam. The Einzel lens may be used instead of, or in combination with, the adjustable electrodes already described.

A TOFMS apparatus of the present invention was first modeled using SIMION 7, a commercially available ion optic modeling program (SIMION 7, P.O. Box 2726, Idaho Falls, Ind. 83403, USA), and then a prototype constructed to test the performance and compare the figures of merit to values reported in the prior art.

The addition of the four trim electrodes to an electric sector provides up to four additional adjustments, or degrees of freedom, for tuning the ion optical properties of each of the electric sectors. It is not necessary or even desirable in modeling the ion optics to use all of these degrees of freedom. In the model, it is not necessary to correct for small errors in the mechanical alignment of the sectors, so these adjustments are not needed.

Thus, for modeling purposes, we used only the sum and the difference of the potentials on the inner and outer trim electrodes as adjustable parameters in the tuning of the spectrometer. The same potential is applied to all of the outer trim electrodes and yet another potential is applied to all of the inner trim electrodes. It is understood that the present invention is not limited to potentials applied in this pattern, and that other possible subsets (up to and including individual trim electrodes) may each have different applied potentials.

TABLE 1

Modeled Invention Embodiment Dimensions and Potentials

| Parameter | Modeled Invention Embodiment |
|---|---|
| Electric Sector Radius | 2.00 |
| Deflection Angle | 270 degrees |
| D1 | 4.76 |
| D2 | 3.12 |
| $S_S$ | 0.36 |
| $W_M$ | 0.20 |
| $H_S$ | 1.12 |
| $S_M$ | 0.12 |
| Trim Electrode Thickness ($T_T$) | 0.16 |
| Trim Electrode Spacing ($T_S$) | 0.22 |
| Trim Electrode to Sector Electrode Space($TE_S$) | 0.14 |
| Herzog shunt thickness ($H_T$) | 0.16 |
| Herzog shunt spacing to Trim Electrode ($HT_S$) | 0.14 |
| Herzog shunt opening height ($H_H$) | 0.40 |
| Herzog shunt opening width ($H_W$) | 0.20 |
| Ion Acceleration Voltage | 10,000 volts |
| Potential on Electric Sector Outer Electrode | 1739 volts |
| Potential on Electric Sector Inner Electrode | −1971 volts |
| Potential on Matsuda Plates | 183 volts |
| Potential on Inner Trim Electrodes | 339 volts |
| Potential on Outer Trim Electrodes | 343 volts |

The set of operating potentials given in Table 1 is the best of many combinations found during modeling which produces a maximum resolution for 10 kV ions in this particular geometry. The tuning of the model was carried out by minimizing the sum of the absolute magnitudes of all of the first and second order aberration coefficients for the time-of-flight. Because the deviations in x (in the plane of the ion flight path, perpendicular to the path of the reference ion) and the corresponding angle a are not symmetrical for this design, the aberrations for these deviations were also calculated, adding an additional 11 terms to the 20 normally included in the sum. The values for the deviations $X_0$, $\alpha_0$, $y_0$, $\beta_0$, and $\delta$ used for the optimization were 0.2 mm, 0.2 degrees, 0.2 mm, 0.2 degrees, and 0.001 which gave an optimized resolution of over 16,000 when all 31 aberration terms are included in the calculation.

The results of these calculations for this set of potentials are compared in Table 2 with the aberration coefficients disclosed in Sakurai et al., "A New Time-Of-Flight Mass Spectrometer", *Int. J. Mass. Spectrom. Ion Proc.* 66, pp 283-290 (1985) ("Sakurai I"); definitions of the aberration coefficients are as described in "Sakurai I" and in Sakurai et al., "Ion Optics For Time-Of-Flight Mass Spectrometers With Multiple Symmetry", *Int. J. Mass. Spectrom. Ion Proc.* 63, pp 273-287 (1985) ("Sakurai II").

TABLE 2

Comparison of Aberration Coefficients

| Aberration Coefficient | Sakurai I | Modeled Invention Embodiment |
|---|---|---|
| $L_x$ | 0.0000 | 0.0005 |
| $L_\alpha$ | 0.0000 | 0.0003 |
| $L_\delta$ | 0.0000 | 0.0000 |
| $L_{xx}$ | 137.94 | 115.00 |
| $L_{x\alpha}$ | 18.75 | 3.72 |
| $L_{x\delta}$ | 5.66 | 2.00 |
| $L_{\alpha\alpha}$ | 1.79 | 0.67 |
| $L_{\alpha\delta}$ | 1.08 | 0.26 |
| $L_{\delta\delta}$ | 0.73 | 2.90 |
| $L_{yy}$ | 0.00 | 0.0000 |
| $L_{y\beta}$ | 0.00 | 1.00 |
| $L_{\beta\beta}$ | −0.02 | 0.39 |

While some of the aberration coefficients of the modeled embodiment of the present invention are smaller and some are larger than those of Sakurai, the two which make the largest contribution to the peak width, $L_{\alpha\alpha}$, and $L_{\alpha\delta}$, are significantly smaller, with the result that the overall spectrometer resolution of the modeled embodiment of the present invention is improved over that reported in the prior art.

For example, with $X_0=y_0=0.0002$ meters and $\alpha_0=\beta_0=0.00349$ radians and $\delta=0.001$, the predicted resolution using the calculation of Sakurai I, which includes only the aberration coefficients listed in Table 2, is about 19,000 for the original design, but is over 30,000 for the modeled embodiment of the present invention.

The predicted resolution depends on the magnitudes assumed for the deviations $x_0$, $y_0$, $\alpha_0$, $\beta_0$, and $\delta$. Furthermore, with the present invention, the properties of the time-of-flight spectrometer may be adjusted to provide the best performance for the actual deviations expected from the reference ion properties. For example, it is well known that ions produced by commonly employed matrix-assisted laser desorption ionization (MALDI) methods have on average considerable excess energy and that the average amount of this extra energy is proportional to the mass of the ion. The magnitude of this excess energy is approximately one electron volt per 1000 daltons. Thus, the ions formed from large proteins can have over 100 eV of extra energy, on average, with a distribution in energies of this same magnitude. A MALDI time-of-flight mass spectrometer operating at 10,000 volt nominal ion energy would have an energy deviation $\delta$ of 0.01 or more for large proteins, but the value would be only 0.0002 or less for small peptides with masses below 2000 daltons. A time-of-flight spectrometer according to this invention has ion optical properties which may be changed by changing the potentials applied to the various elements, including the trim electrodes. Thus, this invention makes it possible to tune the spectrometer for best performance with larger δ which gives best resolution for large proteins, or to tune for best resolution with small δ, which gives the best performance for peptides. Furthermore, the desired tuning condition may be obtained by simply changing the potentials applied to the electrodes of the spectrometer.

Each of the trim electrodes of apparatus 200 has an electric potential that may be independently adjustable with respect to others of the adjustable trim electrodes and with respect to the electric sector deflecting electrodes. Therefore, each ion optical element may be configured to modify specifically the potential experienced by an ion entering or exiting the electric sector with which the ion optical element is associated. The effects of these adjustments are similar to those described hereinabove for apparatus 100. Therefore, each element and trim electrode may constitute an additional degree of freedom to modify the ion focusing properties of the electric sectors. These adjustments, in combination with the known advantages of the symmetric arrangement of flight path 60, allow even greater control over and improvement of the mass resolution and/or sensitivity.

An exemplary electric sector time-of-flight mass spectrometer of the present invention ("Physical Embodiment A" or equivalently, "Embodiment A") was constructed with the parameters provided in Table 3.

TABLE 3

Dimensions and Potentials of Embodiment A

| Parameter | Physical Embodiment A |
|---|---|
| Electric Sector Radius | 3.00 |
| Deflection Angle | 270 degrees |
| D1 | 7.14 |
| D2 | 4.68 |
| $S_S$ | 0.54 |
| $W_M$ | 0.30 |
| $H_S$ | 1.68 |
| $S_M$ | 0.18 |
| Trim Electrode Thickness ($T_T$) | 0.24 |
| Trim Electrode Spacing ($T_S$) | 0.33 |
| Trim Electrode to Sector Electrode Space ($TE_S$) | 0.21 |
| Herzog shunt thickness ($H_T$) | 0.24 |
| Herzog shunt spacing to Trim Electrode ($HT_S$) | 0.21 |
| Herzog shunt opening height ($H_H$) | 0.60 |
| Herzog shunt opening width ($H_W$) | 0.30 |
| Ion Acceleration Voltage | 20,000 volts |
| Potential on Electric Sector Outer Electrode | 3224 volts |
| Potential on Electric Sector Inner Electrode | −4181 volts |
| Potential on Matsuda Plates | 549 volts |
| Potential on Inner Trim Electrodes | 655 volts |
| Potential on Outer Trim Electrodes | 676 volts |

The apparatus of the present invention designated Embodiment A was constructed in accordance with the dimensions provided in Table 3 and is schematically depicted in FIGS. 3, 4, 5A and 5B. Other attributes of this embodiment, unless specified otherwise hereinbelow or in Table 3, are substantially similar to those described above with respect to the theoretical embodiment described above.

To demonstrate the features and/or advantages of the present invention, representative mass spectrometer experiments were performed with the Embodiment A electric sector time-of-flight mass spectrometer. Unless otherwise specified, the preparation of the samples, the operation of the mass spectrometer, and acquisition of the time-of-flight mass spectrum were performed in accordance with methods and protocols known and understood by one of ordinary skill in the art. The potentials of the electrodes in Embodiment A were applied as set forth in Table 3. The experiments and results described below are illustrative and exemplary only, and are not meant to be limiting with respect to the features, advantages and uses of the present invention.

EXAMPLE 1

Spectral Range (IgG)

The mass spectrometer of the present invention provides well-defined signals over a large spectral range. Spectral range is a characteristic of the mass spectrum and refers to the spectrometer's ability to detect and measure a broad range of masses from a given sample within a single spectrum. Ions outside the spectral range are usually not detectable and hence do not appear on the mass spectrum. Therefore, a spectrometer that provides a mass spectrum with a large mass range of interest may allow detection and measurement of a larger number of ions than one with a smaller spectral range.

Figure 6A:
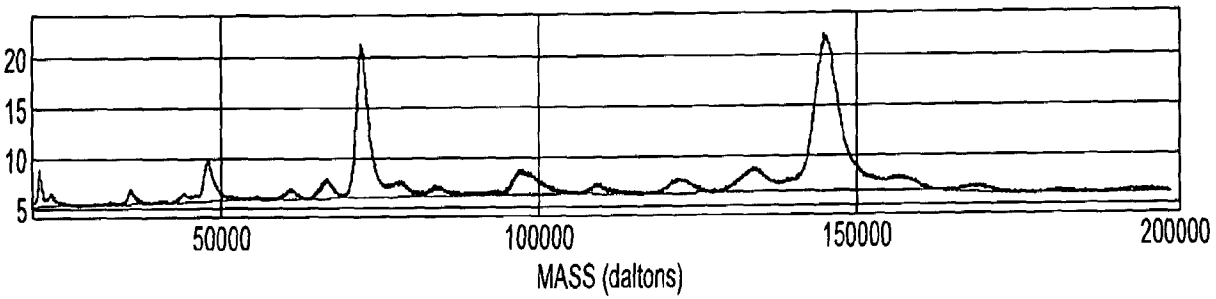
FIGS. 6A, 6B and 6C are portions of an exemplary mass spectrum of IgG (immunoglobulin G) obtained using an apparatus in accordance with the present invention.
Figure 6B:
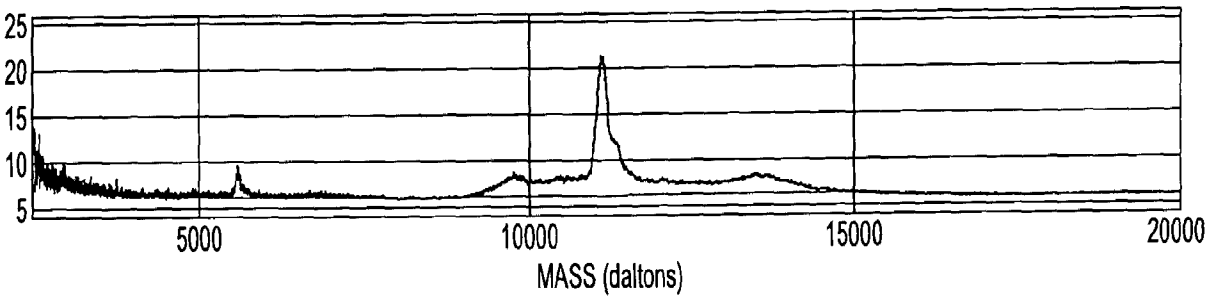
Figure 6C:
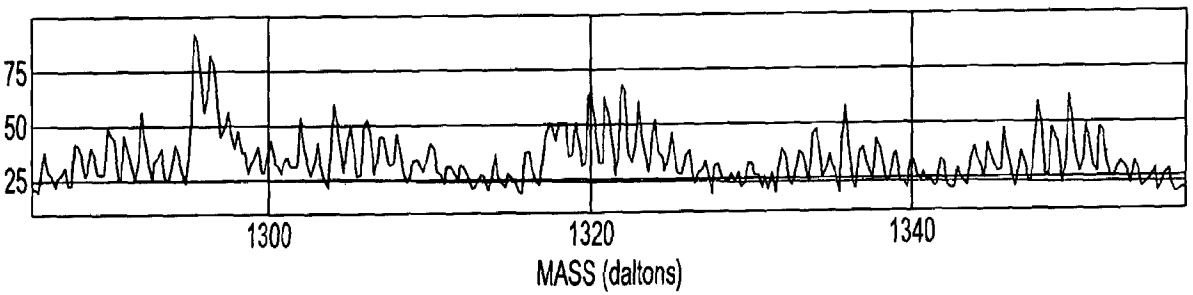
Figure 7A:
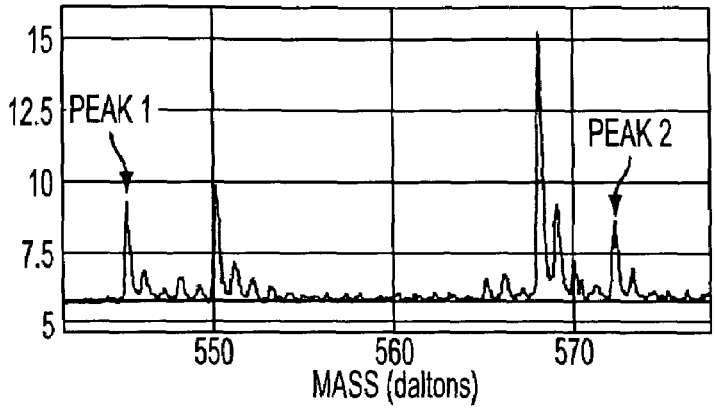
FIGS. 7A-7H are portions of an exemplary mass spectrum of a tryptic digest of bovine serum albumin using an apparatus in accordance with the present invention.
Figure 7B:
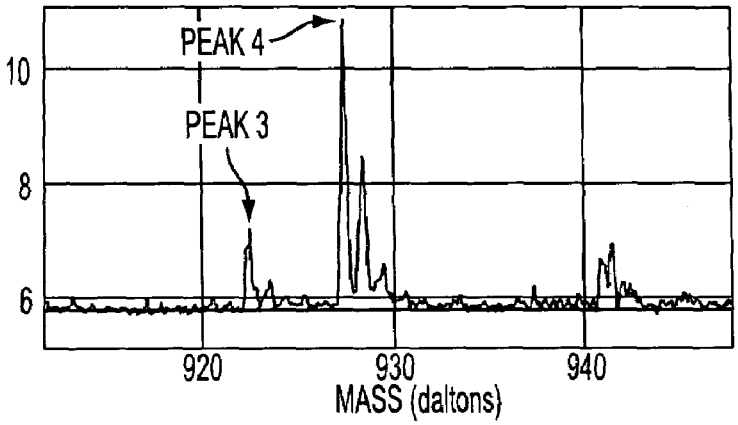
Figure 7C:
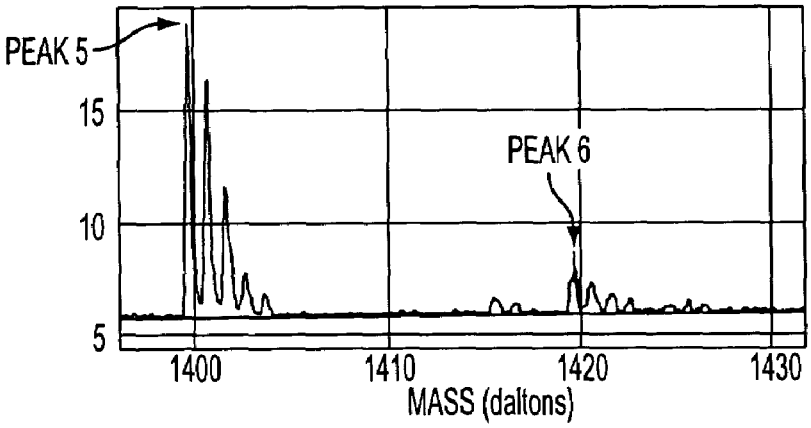
Figure 7D:
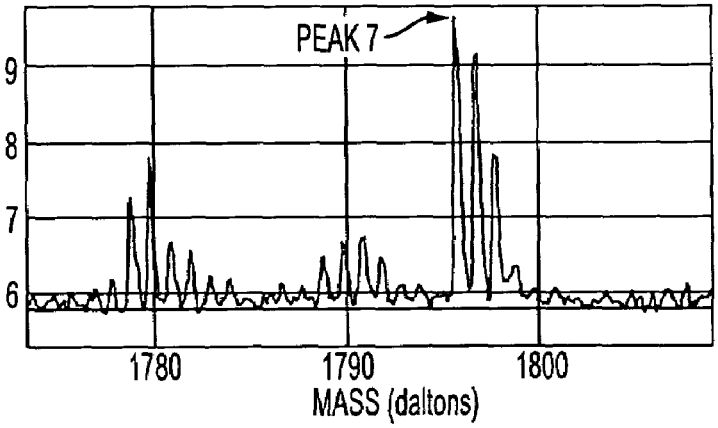
Figure 7E:
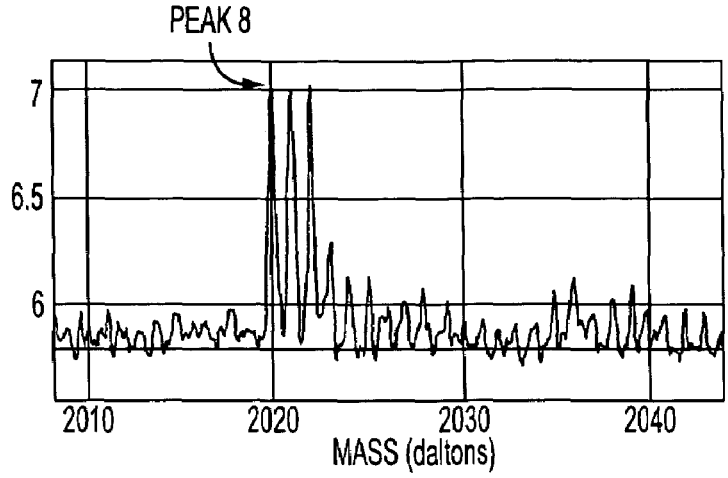
Figure 7F:
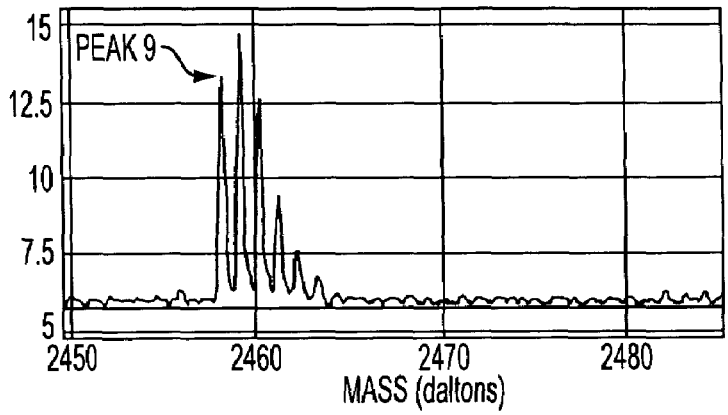
Figure 7G:
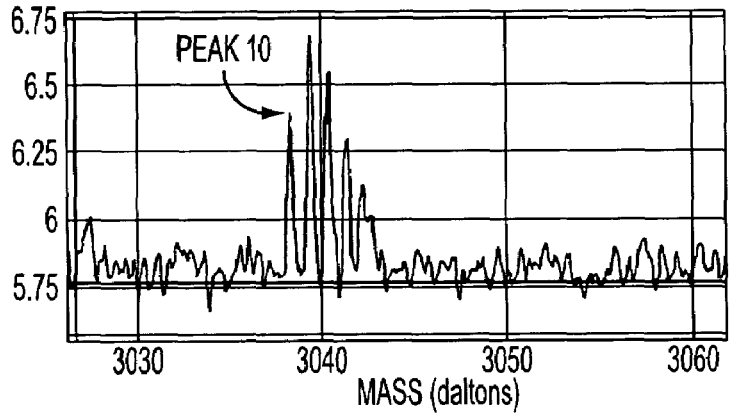
Figure 7H:
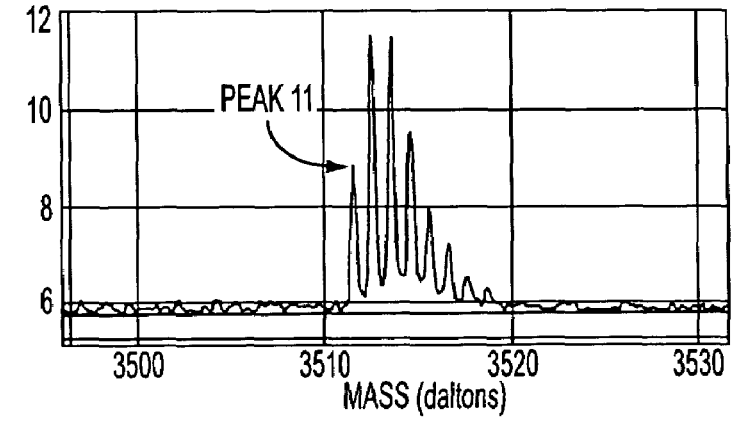

To demonstrate the spectral range of the present invention, the apparatus of Embodiment A was used to obtain a TOF mass spectrum of IgG in a sinapinic acid ("SPA") matrix on a gold chip. The sample was ionized by delayed extraction laser desorption ionization and the ions were detected with a sampling rate of 250 MHz. Referring to FIGS. 6A-6C, three portions of the TOF mass spectrum are shown, each portion rescaled along its horizontal axis. In this mass spectrum, signals representing ions having masses from 1.3 kDa to 146.4 kDa were observed. Therefore, this example demonstrates that the apparatus of the present invention can provide a single mass spectrum with a large spectral range.

EXAMPLE 2

Spectral Range and Sensitivity (Peptide)

This experiment was performed to determine the spectral range and sensitivity of the apparatus with a peptide sample. In a manner similar to that described in Example 1, a tryptic digest of 100 fmole of bovine serum albumin ("BSA") was prepared on a SEND-C18 chip (Ciphergen Biosystems™) and a mass spectrum was obtained. Referring to FIG. 7A-7H, eight portions from the single mass spectrum obtained are shown. The measured masses and resolutions of the peaks indicated are listed in Table 4 below. This experiment demonstrates that the masses of individual peptides may be obtained with high accuracy and resolution as measured in a single mass spectrum.

TABLE 4

Selected Peptide Masses and Resolution

| Peak | Mass | Resolution |
|---|---|---|
| 1 | 545.334 | 1560 |
| 2 | 572.323 | 1460 |
| 3 | 922.467 | 3180 |
| 4 | 927.464 | 2390 |
| 5 | 1399.7 | 3920 |
| 6 | 1419.76 | 3990 |
| 7 | 1795.85 | 5290 |
| 8 | 2019.96 | 5400 |
| 9 | 2458.19 | 6710 |
| 10 | 3038.2 | 7530 |
| 11 | 3511.57 | 8540 |

Figure 8A:
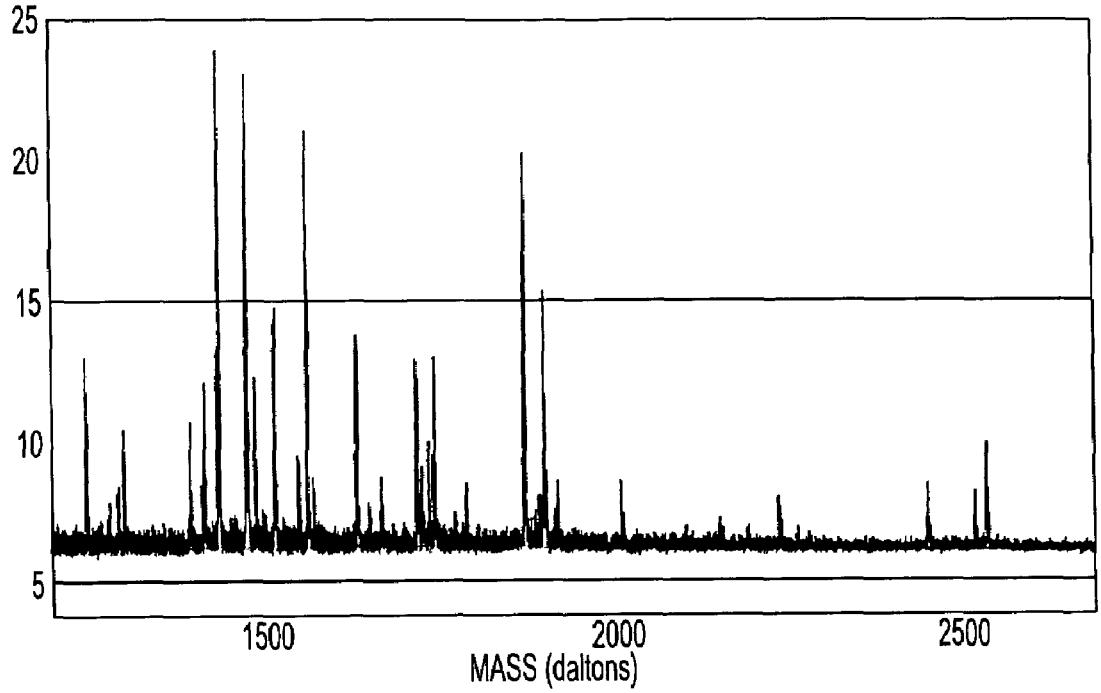
FIGS. 8A and 8B are portions of an exemplary mass spectrum of a tryptic digest of bovine serum albumin using an apparatus in accordance with the present invention.
Figure 8B:
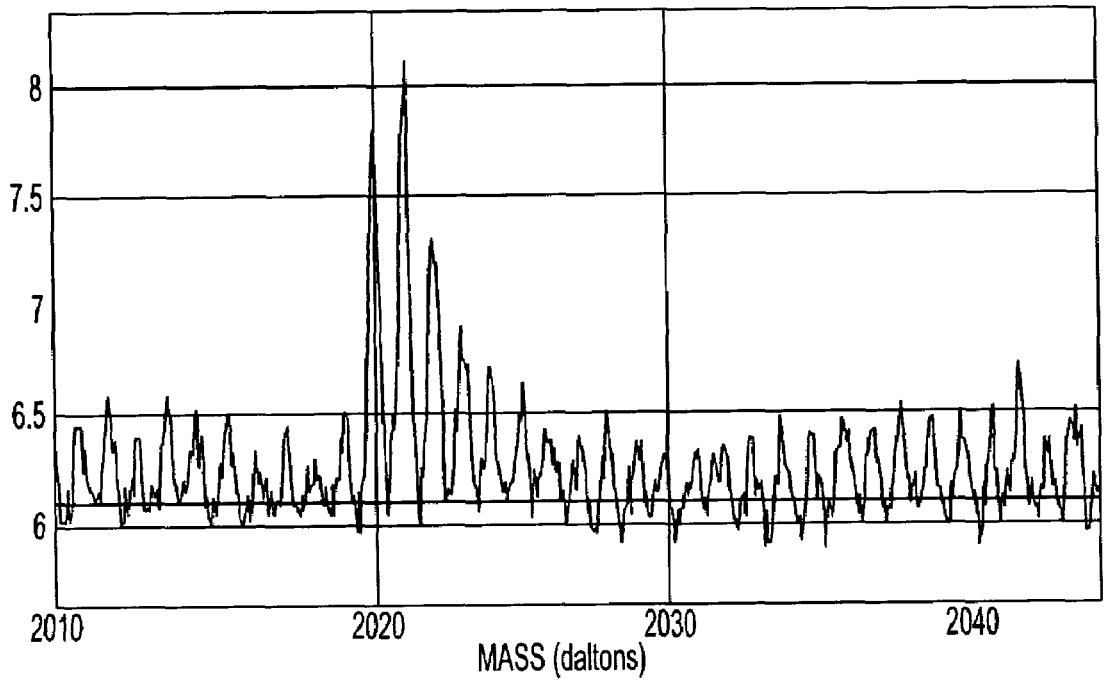

In order to determine the sensitivity of the apparatus, the experiment was repeated with decreasing amounts of BSA digest. As listed in Table 5 below, the sensitivity of the apparatus allows detection of a significant number of peptides constituting a substantial percentage of the original protein sequence, even when starting with low-femtomolar quantities of the sample protein. FIG. 8A depicts the TOF mass spectrum of a tryptic digest of 1 fmole of BSA. FIG. 8B depicts an expanded section of the mass spectrum of FIG. 8A.

TABLE 5

Sensitivity of Peptide Detection

| Amount of BSA Digest | Number of BSA Peptides Detected | Percent Coverage of BSA Sequence |
|---|---|---|
| 100 fmole | 92 | 93 |
| 10 fmole | 64 | 81 |
| 1 fmole | 44 | 66 |

EXAMPLE 3

Mass Accuracy

To determine the mass accuracy of the present invention, the mass spectra of eight samples of a peptide mixture were acquired using the mass spectrometer of Embodiment A. All eight samples were introduced on a single gold chip in a cyanohydroxycinnamic acid ("CHCA") matrix. The numbers listed in Table 6 were calculated from the corresponding peptide signals measured by these mass spectra As shown below, accurate masses for all five peptides were obtained using the Embodiment A mass spectrometer apparatus.

TABLE 6

TOF Mass Spectra of Peptide Mixture (8 measurements)

| | Arg8-Vasopressin | Somatostatin | Dynorphin A | Insulin β-chain | Insulin αβ-chains |
|---|---|---|---|---|---|
| True Mass | 1083.438 | 1636.717 | 2146.191 | 3493.644 | 5807.653 |
| Average Mass | 1083.405 | 1636.700 | 2146.192 | 3493.569 | 5806.877 |
| SD (ppm) | 37.3 | 32.1 | 26.2 | 26.5 | 57.9 |
| Range (ppm) | 116.2 | 103.0 | 80.7 | 72.8 | 155.3 |
| Avg. Err. (ppm) | 40.1 | 23.7 | 18.9 | 26.6 | 133.7 |
| Avg.-True (ppm) | −30.1 | 10.2 | 0.1 | −21.3 | −133.7 |
| TOF Avg. (μsec) | 45.8447 | 56.3129 | 64.4642 | 82.2101 | 105.9537 |
| TOF SD (ppm) | 18.6 | 16.0 | 13.1 | 13.2 | 28.9 |

EXAMPLE 4

Mass Resolution

Figure 9:
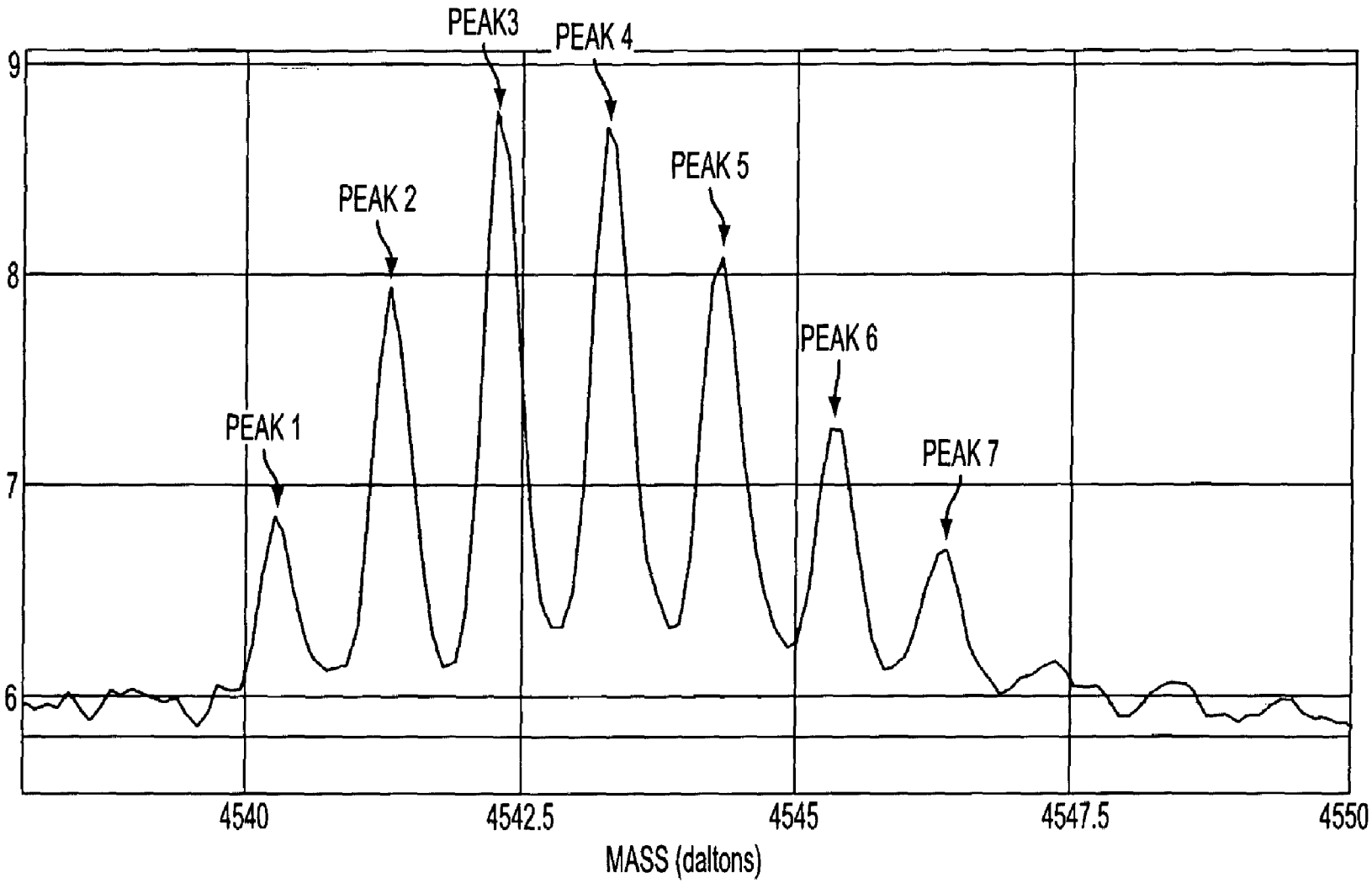
FIG. 9 is an exemplary mass spectrum of adrenocorticotropic hormone using an apparatus in accordance with the present invention.

To demonstrate the mass resolution of the present invention, the mass of adrenocorticotropic hormone ("ACTH") was measured using the Embodiment A apparatus. The resulting mass spectrum is shown in FIG. 9, and the mass and resolution of each labeled peak in the mass spectrum is listed below in Table 7.

TABLE 7

Measured masses and resolutions of ACTH Spectrum

| Peak | Mass | Resolution |
|---|---|---|
| 1 | 4540.28 | 10394.6 |
| 2 | 4541.33 | 10306 |
| 3 | 4542.31 | 10651.1 |
| 4 | 4543.29 | 10305.6 |
| 5 | 4544.3 | 9178.79 |
| 6 | 4545.34 | 9105.81 |
| 7 | 4546.31 | 8430.71 |

It is understood that the foregoing experiments and their results are only examples and illustrations of the uses, parameters, and advantages of the present invention. These experiments and results are therefore not meant to be limiting with respect to the type or scope of the features, advantages and uses of the present invention. Other uses, applications and advantages of the present invention will be apparent to those skilled in the art upon review of the specification.

It is understood that the apparatuses described herein are only examples of the many alternative embodiments contemplated by the present invention. For example, although these embodiments illustrate ion optical elements disposed at every entry and outlet of all electric sectors, this configuration is not a requirement. For example, in a TOF mass spectrometer comprising more than one electric sector, it may be desirable to situate ion optical elements only at the entry of the first electric sector and only at the outlet of the final electric sector, with no ion optical elements between contiguous electric sectors. Other similar combinations are easily conceivable. Likewise, the present invention contemplates alternative embodiments in which the quantity, shape, size, relative position, and other properties of the ion optical elements and trim electrodes are different from those illustrated in FIGS. 1, 2, 3,4, 5A, 5B and 10.

Furthermore, it is not required that all of the electric sectors in a TOF mass spectrometer be identical in geometry, size, ion focusing, or other properties. Similarly, the present invention is not limited to any particular arrangement, symmetric or otherwise, of the multiple electric sectors and free-flight regions.

It is also understood that one of ordinary skill would recognize that the Herzog shunts or Matsuda plates, as described above, are dispensable elements. They would also recognize that the Herzog shunts or Matsuda plates could be incorporated into a partial or full enclosure of the electric sector or sectors of the time-of-flight mass spectrometer, as depicted schematically in FIG. 10 in a top cross-sectional view. With respect to FIG. 10, apparatus 300 comprises enclosure 370 that incorporates the functionalities of Herzog shunts and/or Matsuda plates. Enclosure 370 further comprises aperture 375 and 376 that allow entry and exit, respectively, of the ion flight path. These and other embodiments are within the scope of the present invention and would be apparent to one of ordinary skill in the art, and their suitability would depend on the analytical circumstances or desired features.

A TOF mass spectrometer of the present invention may also comprise electronic and/or computational means for controlling and adjusting the trim electrodes. For example, a control system such as a computer may be configured to monitor and adjust the potentials on one or more of the trim electrodes. Such a control system is capable of monitoring and adjusting the adjustable trim electrodes with a high degree of accuracy and precision. The control system may further comprise a software program configured to control the adjustable trim electrodes. For example, the software may be programmed to confer potentials to each of the adjustable trim electrodes in arrangements suitable for a particular sample or analytical application.

In another aspect of the invention, the present invention provides methods for tuning a TOF mass spectrometer in order to improve the mass resolution or sensitivity of the mass spectrum. The TOF mass spectrometer includes one or more ion focusing electric sectors, at least one of which is associated with at least one ion optical element. Each ion optical element comprises at least one adjustable electrode. Suitable TOF mass spectrometers for this method include, but are not limited to, the embodiments described hereinabove.

In one embodiment, the method comprises determining a first mass spectrum using a mass spectrometer of the present invention, from which a first mass resolution or sensitivity is determined. A potential may be applied to at least one trim electrode prior to determining the first mass spectrum.

Following the first mass determination, the potential of at least one trim electrode of the apparatus is adjusted. A second mass spectrum is subsequently determined, from which a corresponding second mass resolution or sensitivity is determined. By comparing the relative improvement or degradation of the mass resolution or sensitivity between the first and second mass spectra, the improvement or degradation may be correlated with the intervening adjustment made to the ion optical elements. If, for example, the second spectrum demonstrates a higher mass resolution or sensitivity relative to the first spectrum, further improvement may be pursued by determining a third mass spectrum after further adjustment of the trim electrode in the same direction. Accordingly, adjustment in the opposite direction may be required if the second spectrum is demonstrated to be degraded with respect to the first spectrum as a result of the intervening adjustment.

Further tuning may be performed in this iterative manner until a desired or sufficient mass resolution or sensitivity is achieved. The tuning method of the present invention may be used to attain the desired resolution and/or sensitivity for particular samples and analytical applications. For example, the trim electrodes of the mass spectrometer may be tuned to optimize the mass spectrometer for determining a mass spectrum for a peptide sample. Similarly, the mass spectrometer may instead be tuned for the optimal determination of a mass spectrum of a protein sample. One skilled in the art would understand that tuning in this manner may be performed to provide optimal settings for any suitable substrate. Furthermore, optimal tuning settings for a given substrate type may be determined beforehand by the manufacturer and/or the operator. These settings may be available in the documentation or pre-programmed for the apparatus.

This tuning method, as well as adjustments of the trim electrodes in general, may be performed more quickly, precisely, and/or accurately by using an apparatus that further comprises the control system as described above. The control system may be configured to, for example, compare the properties of the mass spectra determined at different settings and/or adjust the trim electrode settings accordingly. The control system may comprise a computer, electronics, software programs, algorithms, and the like. Predetermined optimized settings, as described above, may be stored in the apparatus and used by the software program to quickly and accurately set the trim electrodes to the appropriate settings.

All patents, patent publications, and other published references mentioned herein are hereby incorporated by reference in their entireties as if each had been individually and specifically incorporated by reference herein. By their citation of various references in this document, applicants do not admit that any particular reference is "prior art" to their invention.

While specific examples have been provided, the above description is illustrative and not restrictive. Any one or more of the features of the previously described embodiments can be combined in any manner with one or more features of any other embodiments in the present invention. Furthermore, many variations of the invention will become apparent to those skilled in the art upon review of the specification. The scope of the invention should, therefore, be determined not with reference to the above description, but instead should be determined with reference to the appended claims along with their full scope of equivalents.

What is claimed is:

1. A tandem mass spectrometer comprising:

an ion source;

a first mass analyzer;

a second mass analyzer; and an ion detector, wherein the ion source is configured to provide ions or fragments thereof to the first mass analyzer, the first mass analyzer is configured to provide ions or fragments thereof to the second mass analyzer, and the second mass analyzer is configured to provide ions or fragments thereof to the ion detector; and wherein the first mass analyzer comprises an electric sector time-of-flight (ES-TOF) mass analyzer, the ES-TOF mass analyzer comprising:

an ion flight path means defining a flight path for ions and having an ion entrance and an ion exit, the ion flight path means comprising:

at least one field free region, at least one electric sector having an entry and an outlet, and at least one trim electrode disposed at the entry or the outlet of at least one of the electric sectors, wherein the at least one trim electrode is configured to modify the potential experienced by an ion entering or exiting the electric sector.

2. The tandem mass spectrometer of claim 1 further comprising an ion fragmentor, wherein the ion fragmentor is configured to:

receive at least one ion from the first mass analyzer;

fragment at least one of the ions thus received; and provide at least one of the fragmented ions to the second mass analyzer.

3. The tandem mass spectrometer of claim 1 further comprising an ion selector, wherein the ion selector is configured to:

receive a plurality of ions from the first mass analyzer;

select at least one of the plurality of ions thus provided; and provide at least one of the selected ions to the second mass analyzer.

4. The tandem mass spectrometer of claim 1 further comprising:

an ion selector; and an ion fragmentor, wherein the ion selector is configured to receive a plurality of ions from the first mass analyzer, select at least one of the plurality of ions thus provided, and provide at least one of the selected ions to the ion fragmentor, and wherein the ion fragmentor is configured to receive at least one of the ions provided by the ion selector, fragment at least one of the ions thus received, and provide at least one of the fragmented ions to the second mass analyzer.

5. The tandem mass spectrometer of claim 1, wherein the ion source comprises a laser desorption/ionization ion source.

6. The tandem mass spectrometer of claim 1, wherein the second mass analyzer comprises a mass analyzer selected from the group consisting of: an electric sector time-of-flight mass analyzer, a linear time-of-flight mass analyzer, a reflecting time-of-flight mass analyzer, a linear ion trap, a quadrupole ion trap, a quadrupole mass filter, a magnetic sector mass analyzer, an electric sector/magnetic sector mass analyzer, an ion trap/linear time-of-flight mass analyzer, an ion trap/reflecting time-of-flight mass analyzer, and an electrostatic mass analyzer.

7. The tandem mass spectrometer of claim 1, wherein:

the at least one electric sector of the ES-TOF mass analyzer of the first mass analyzer is at least four sequentially-ordered electric sectors; and the at least one field free region of the ES-TOF mass analyzer of the first mass analyzer is at least three field free regions, wherein at least the first, second, and third electric sectors are each followed by at least one of the field free regions.

8. The tandem mass spectrometer of claim 7, wherein each of the at least one electric sectors of the ES-TOF mass analyzer of the first mass analyzer have a deflection angle of about 270 degrees.

9. The tandem mass spectrometer of claim 1, wherein each of the at least one trim electrodes is a pair of trim electrodes, and wherein the ion flight path passes between the trim electrodes of each pair of trim electrodes.

10. The tandem mass spectrometer of claim 1 or claim 9, wherein at least one of the trim electrodes is adjustable, whereby adjusting the adjustable trim electrodes changes the potential modification experienced by an ion entering or exiting the electric sector with which the adjustable trim electrode is associated.

11. The tandem mass spectrometer of claim 1, wherein the ion source comprises means for selectively providing ions of at least one mass or at least one range of masses.

12. The tandem mass spectrometer of claim 11, wherein the means for selectively providing ions comprises a guadrupole ion trap or a linear ion trap.

13. The tandem mass spectrometer of claim 1, wherein the ion detector further comprises a recorder, wherein the recorder is configured to record the ions detected by the ion detector, thereby generating a mass spectrum.

14. A tandem mass spectrometer comprising:

an ion source;

a first mass analyzer;

a second mass analyzer; and an ion detector, wherein the ion source is configured to provide ions or fragments thereof to the first mass analyzer, the first mass analyzer is configured to provide ions or fragments thereof to the second mass analyzer, and the second mass analyzer is configured to provide ions or fragments thereof to the ion detector; and wherein the second mass analyzer comprises an electric sector time-of-flight (ES-TOF) mass analyzer, the ES-TOF mass analyzer comprising:

an ion flight path means defining a flight path for ions and having an ion entrance and an ion exit, the ion flight path means comprising:

at least one field free region, at least one electric sector having an entry and an outlet, and at least one trim electrode disposed at the entry or the outlet of at least one of the electric sectors, wherein the at least one trim electrode is configured to modify the potential experienced by an ion entering or exiting the electric sector.

15. The tandem mass spectrometer of claim 14 further comprising an ion fragmentor, wherein the ion fragmentor is configured to:

receive at least one ion from the first mass analyzer;

fragment at least one of the ions thus received; and provide at least one of the fragmented ions to the second mass analyzer.

16. The tandem mass spectrometer of claim 14 further comprising an ion selector, wherein the ion selector is configured to:

receive a plurality of ions from the first mass analyzer;

select at least one of the plurality of ions thus provided; and provide at least one of the selected ions to the second mass analyzer.

17. The tandem mass spectrometer of claim 14 further comprising:

an ion selector; and an ion fragmentor, wherein the ion selector is configured to receive a plurality of ions from the first mass analyzer, select at least one of the plurality of ions thus provided, and provide at least one of the selected ions to the ion fragmentor, and wherein the ion fragmentor is configured to receive at least one of the ions provided by the ion selector, fragment at least one of the ions thus received, and provide at least one of the fragmented ions to the second mass analyzer.

18. The tandem mass spectrometer of claim 14, wherein the ion source comprises a laser desorption/ionization ion source.

19. The tandem mass spectrometer of claim 14, wherein the first mass analyzer comprises a mass analyzer selected from the group consisting of: an electric sector time-of-flight mass analyzer, a linear time-of-flight mass analyzer, a reflecting time-of-flight mass analyzer, a linear ion trap, a quadrupole ion trap, a quadrupole mass filter, a magnetic sector mass analyzer, an electric sector/magnetic sector mass analyzer, an ion trap/linear time-of-flight mass analyzer, an ion trap/reflecting time-of-flight mass analyzer, and an electrostatic mass analyzer.

20. The tandem mass spectrometer of claim 14, wherein:

the at least one electric sector of the ES-TOF mass analyzer of the second mass analyzer is at least four sequentially-ordered electric sectors; and the at least one field free region of the ES-TOF mass analyzer of the second mass analyzer is at least three field free regions, wherein at least the first, second, and third electric sectors are each followed by at least one of the field free regions.

21. The tandem mass spectrometer of claim 20, wherein each of the at least one electric sectors of the ES-TOF mass analyzer of the second mass analyzer have a deflection angle of about 270 degrees.

22. The tandem mass spectrometer of claim 14, wherein each of the at least one trim electrodes is a pair of trim electrodes, and wherein the ion flight path passes between the trim electrodes of each pair of trim electrodes.

23. The tandem mass spectrometer of claim 14 or claim 22, wherein at least one of the trim electrodes is adjustable, whereby adjusting the adjustable trim electrodes changes the potential modification experienced by an ion entering or exiting the electric sector with which the adjustable trim electrode is associated.

24. The tandem mass spectrometer of claim 14, wherein the ion source comprises means for selectively providing ions of at least one mass or at least one range of masses.

25. The tandem mass spectrometer of claim 24, wherein the means for selectively providing ions comprises a quadrupole ion trap or a linear ion trap.

26. The tandem mass spectrometer of claim 14, wherein the ion detector further comprises a recorder, wherein the recorder is configured to record the ions detected by the ion detector, thereby generating a mass spectrum.

* * * * *